US008863852B2

(12) United States Patent
Clausen

(10) Patent No.: US 8,863,852 B2
(45) Date of Patent: Oct. 21, 2014

(54) WIRED MULTI-OPENING CIRCULATING SUB

(75) Inventor: Jeffery Ronald Clausen, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 320 days.

(21) Appl. No.: 12/743,787

(22) PCT Filed: Nov. 20, 2008

(86) PCT No.: PCT/US2008/084177

§ 371 (c)(1),
(2), (4) Date: May 19, 2010

(87) PCT Pub. No.: WO2009/067588

PCT Pub. Date: May 28, 2009

(65) Prior Publication Data

US 2010/0270034 A1 Oct. 28, 2010

Related U.S. Application Data

(60) Provisional application No. 60/989,345, filed on Nov. 20, 2007.

(51) Int. Cl.

| | |
|---|---|
| ***E21B 34/08*** | (2006.01) |
| ***E21B 21/10*** | (2006.01) |
| ***E21B 23/00*** | (2006.01) |

(52) U.S. Cl.

CPC ..... *E21B 23/006* (2013.01); *E21B 21/103* (2013.01)

USPC ..... 166/383; 166/334.4

(58) Field of Classification Search

USPC ..... 166/334.4, 332.8, 72, 383

See application file for complete search history.

(56) References Cited

U.S. PATENT DOCUMENTS

| | | | |
|---|---|---|---|
| 2,348,047 | A | 2/1857 | Yost |
| 2,069,645 | A | 2/1937 | Cardew |
| 2,672,847 | A | 3/1954 | Bergmann |
| 2,743,083 | A | 4/1956 | Zublin |
| 2,746,721 | A | 5/1956 | Moore |

(Continued)

FOREIGN PATENT DOCUMENTS

| | | |
|---|---|---|
| CA | 2178813 | 12/2005 |
| EP | 0787888 B1 | 3/2005 |

(Continued)

OTHER PUBLICATIONS

International Application No. PCT/US2008/083986 Search Report and Written Opinion dated Jul. 16, 2009.

(Continued)

*Primary Examiner* — David Andrews
*Assistant Examiner* — Ronald Runyan
(74) *Attorney, Agent, or Firm* — Conley Rose, P.C.

(57) ABSTRACT

System and method for circulating fluid within a well bore. A circulation sub configured with communication elements on its ends to link the sub to a downhole communication network. A slideable piston in the sub isolates or exposes an outer port on the sub to an inner fluid flow along the sub depending on a signal transmitted along the communication network. Methods for activating the circulation sub via signals transmitted along the downhole communication network.

29 Claims, 23 Drawing Sheets

(56) References Cited

U.S. PATENT DOCUMENTS

| | | | | |
|---|---|---|---|---|
| 2,781,774 | A | 2/1957 | Baker et al. | |
| 2,855,952 | A | 10/1958 | Tausch et al. | |
| 2,920,764 | A | 1/1960 | Hodges | |
| 3,051,246 | A | 8/1962 | Clark, Jr. et al. | |
| 3,054,420 | A | 9/1962 | Williams | |
| 3,199,532 | A | 8/1965 | Trick | |
| 3,385,372 | A | 5/1968 | Knox | |
| 4,103,591 | A | 8/1978 | Reiersdal | |
| 4,256,179 | A | 3/1981 | Shillander | |
| 4,263,936 | A | 4/1981 | Brown | |
| 4,298,077 | A | 11/1981 | Emery | |
| 4,406,335 | A | 9/1983 | Koot | |
| 4,456,063 | A | 6/1984 | Roche | |
| 4,512,417 | A | 4/1985 | Kurt | |
| 4,566,494 | A | 1/1986 | Roche | |
| 4,632,187 | A | 12/1986 | Deaton | |
| 4,905,775 | A | 3/1990 | Warren et al. | |
| 5,271,472 | A * | 12/1993 | Leturno | 175/107 |
| 5,421,420 | A | 6/1995 | Malone et al. | |
| 5,443,129 | A | 8/1995 | Bailey et al. | |
| 5,465,787 | A | 11/1995 | Roth | |
| 5,715,897 | A | 2/1998 | Gustafsson | |
| 5,787,981 | A | 8/1998 | Taylor | |
| 5,901,796 | A | 5/1999 | McDonald | |
| 6,095,249 | A | 8/2000 | McGarian et al. | |
| 6,220,357 | B1 | 4/2001 | Carmichael et al. | |
| 6,253,861 | B1 * | 7/2001 | Carmichael et al. | 175/237 |
| 6,263,969 | B1 | 7/2001 | Stoesz et al. | |
| 6,279,670 | B1 | 8/2001 | Eddison et al. | |
| 6,349,763 | B1 * | 2/2002 | Estep et al. | 166/66.4 |
| 6,431,294 | B1 | 8/2002 | Eddison et al. | |
| 6,439,318 | B1 | 8/2002 | Eddison et al. | |
| 6,508,317 | B2 | 1/2003 | Eddison et al. | |
| 6,588,518 | B2 | 7/2003 | Eddison | |
| 6,634,424 | B2 | 10/2003 | Knowles | |
| 6,670,880 | B1 | 12/2003 | Hall et al. | |
| 6,681,858 | B2 | 1/2004 | Streater | |
| 6,820,697 | B1 | 11/2004 | Churchill | |
| 6,868,906 | B1 | 3/2005 | Vail, III et al. | |
| 6,899,179 | B2 | 5/2005 | McGarian et al. | |
| 6,913,093 | B2 | 7/2005 | Hall et al. | |
| 6,929,493 | B2 | 8/2005 | Hall et al. | |
| 6,945,802 | B2 | 9/2005 | Hall et al. | |
| 7,055,605 | B2 | 6/2006 | Howlett et al. | |
| 7,093,654 | B2 | 8/2006 | Hall et al. | |
| 7,114,581 | B2 | 10/2006 | Aronstam et al. | |
| 7,190,280 | B2 | 3/2007 | Hall et al. | |
| 7,248,177 | B2 | 7/2007 | Hall et al. | |
| 7,252,152 | B2 | 8/2007 | LoGiudice et al. | |
| 7,261,154 | B2 | 8/2007 | Hall et al. | |
| 7,303,022 | B2 | 12/2007 | Tilton et al. | |
| 7,337,847 | B2 | 3/2008 | McGarian et al. | |
| 7,337,850 | B2 | 3/2008 | Contant | |
| 7,357,197 | B2 | 4/2008 | Schultz et al. | |
| 7,461,706 | B2 | 12/2008 | Eddison | |
| 7,523,792 | B2 | 4/2009 | El-Rayes et al. | |
| 7,640,991 | B2 | 1/2010 | Leising | |
| 7,661,478 | B2 | 2/2010 | Palmer et al. | |
| 7,930,071 | B2 | 4/2011 | Nishizawa et al. | |
| 8,167,051 | B2 | 5/2012 | Eddison et al. | |
| 8,263,910 | B2 | 9/2012 | Chiu | |
| 2002/0075114 | A1 * | 6/2002 | Hall et al. | 336/192 |
| 2002/0144842 | A1 | 10/2002 | Schultz et al. | |
| 2002/0150478 | A1 | 10/2002 | Aoki | |
| 2004/0094303 | A1 * | 5/2004 | Brockman et al. | 166/313 |
| 2004/0099447 | A1 | 5/2004 | Howlett et al. | |
| 2004/0150532 | A1 * | 8/2004 | Hall et al. | 340/854.3 |
| 2004/0206548 | A1 | 10/2004 | Aronstam et al. | |
| 2004/0262013 | A1 | 12/2004 | Tilton et al. | |
| 2005/0034875 | A1 * | 2/2005 | McLoughlin et al. | 166/386 |
| 2005/0142999 | A1 | 6/2005 | Uemura | |
| 2005/0205262 | A1 | 9/2005 | Reimert et al. | |
| 2005/0217864 | A1 | 10/2005 | Carmichael | |
| 2005/0230119 | A1 | 10/2005 | McGarian et al. | |
| 2005/0274525 | A1 | 12/2005 | Stevens et al. | |
| 2006/0182429 | A1 | 8/2006 | Shapiro et al. | |
| 2006/0225926 | A1 | 10/2006 | Madhavan et al. | |
| 2006/0243493 | A1 | 11/2006 | El-Rayes et al. | |
| 2006/0278086 | A1 | 12/2006 | Inagaki et al. | |
| 2007/0045006 | A1 | 3/2007 | Krueger et al. | |
| 2007/0056745 | A1 | 3/2007 | Contant | |
| 2008/0029306 | A1 | 2/2008 | Krueger et al. | |
| 2008/0087470 | A1 | 4/2008 | Villareal et al. | |
| 2009/0009967 | A1 | 1/2009 | Nishizawa et al. | |
| 2009/0148141 | A1 | 6/2009 | Shapiro et al. | |
| 2009/0183919 | A1 | 7/2009 | Hall et al. | |
| 2009/0183920 | A1 | 7/2009 | Hall et al. | |

FOREIGN PATENT DOCUMENTS

| | | | |
|---|---|---|---|
| EP | 2088279 | | 8/2009 |
| GB | 2054008 | A | 2/1981 |
| GB | 2108594 | | 5/1983 |
| GB | 2246803 | | 2/1992 |
| WO | 9630621 | | 10/1996 |
| WO | 2004038170 | A1 | 5/2004 |
| WO | 2005019596 | | 3/2005 |
| WO | 2005049960 | | 6/2005 |
| WO | 2005080745 | | 9/2005 |
| WO | 2006016137 | | 2/2006 |
| WO | 2006119008 | A2 | 11/2006 |
| WO | 2008156369 | | 12/2008 |
| WO | 2010046653 | | 4/2010 |

OTHER PUBLICATIONS

International Application No. PCT/US2008/084177 Search Report and Written Opinion dated May 21, 2009.

International Search Report and Written Opinion from International Application No. PCT/GB2007/002553 dated Oct. 4, 2007, 8 pages.

International Search Report for PCT Application No. PCT/US2011/043240 dated Nov. 24, 2011, 5 pages.

Search Report for United Kingdom Patent Application No. GB1201054.2 dated Mar. 14, 2012, 5 pages.

Search Report for United Kingdom Patent Application No. GB1101033.7 dated Jan. 3, 2012, 7 pages.

* cited by examiner

WIRED MULTI-OPENING CIRCULATING SUB

CROSS REFERENCE TO RELATED APPLICATIONS

This application is the U.S. National Stage Under 35 U.S.C. §371 of International Patent Application No. PCTUS2008/084177 filed Nov. 20, 2008, which claims the benefit of U.S. Provisional Patent Application No. 60/989,345, titled "Circulation Sub with Indexing Slot", filed on Nov. 20, 2007, the entire disclosure of which is incorporated herein by reference. This application is related to U.S. Patent Application No. PCT/US08/83986, titled "Circulation Sub with Indexing Mechanism", filed on Nov. 19, 2008, the entire disclosure of which is incorporated herein by reference.

STATEMENT REGARDING FEDERALLY SPONSORED RESEARCH OR DEVELOPMENT

Not applicable.

BACKGROUND

1. Technical Field

This invention relates generally to an apparatus and method for selectively circulating fluid in a well bore. More particularly, the invention relates to a selectively and continually actuatable circulation sub or valve and its method of use in, for example, well bore operations, including drilling, completion, workover, well clean out, coiled tubing, fishing and packer setting.

2. Description of Related Art

When drilling an oil, gas, or water well, a starter hole is first drilled, and the drilling rig is then installed over the starter hole. Drill pipe is coupled to a bottom hole assembly ("BHA"), which typically includes a drill bit, drill collars, stabilizers, reamers and other assorted subs, to form a drill string. The drill string is coupled to a kelly joint and rotary table and then lowered into the starter hole. When the drill bit reaches the base of the starter hole, the rotary table is powered and drilling may commence. As drilling progresses, drilling fluid, or "mud", is circulated down through the drill pipe to lubricate and cool the drill bit as well as to provide a vehicle for removal of drill cuttings from the borehole. The drilling fluid may also provide hydraulic power to a mud motor. After emerging from the drill bit, the drilling fluid flows up the borehole through the annulus formed by the drill string and the borehole, or the well bore annulus.

During drilling operations, it may be desirable to periodically interrupt the flow of drilling fluid to the BHA and divert the drilling fluid from inside the drill string through a flow path to the annulus above the BHA, thereby bypassing the BHA. For example, the mud motor or drill bit in the BHA tend to restrict allowable fluid circulation rates. Bypassing the BHA allows a higher circulation rate to be established to the annulus. This is especially useful in applications where a higher circulation rate may be necessary to effect good cuttings transport and hole cleaning before the drill string is retrieved. After a period of time, the flow of drilling fluid to the BHA may be reestablished. Redirecting the flow of drilling fluid in this manner is typically achieved by employing a circulation sub or valve, positioned on the drill string above the drill bit.

Typical circulation subs are limited by the number of times they can be actuated in one trip down the borehole. For example, a typical circulation sub may be selectively opened three or four times before it must be tripped out of the borehole and reset. Such a tool operates via the use of a combination of deformable drop balls and smaller hard drop balls to direct fluid flow either from the tool into the borehole annulus or through the tool. As each ball passes through the tool, a ball catcher, positioned at the downhole end of the tool, receives the ball. A drawback to this circulation sub is that the tool may be actuated via a ball drop only a limited number of times, or until the ball catcher is full. Once the ball catcher is full, the tool must be returned to the surface for unloading. After the ball catcher is emptied, the tool may be tripped back downhole for subsequent reuse. Thus, circulation of fluid in the borehole requires repeatedly returning the tool to the surface for unloading and then tripping the tool back downhole for reuse, which is both time-consuming and costly. Furthermore, such circulation subs do not adequately handle dirty fluid environments including lost circulation material, nor do they include open inner diameters for accommodating pass-through tools or obturating members.

Thus, there remains a need for improved apparatus and methods for selectively circulating fluid within a well bore, including continual valve actuation and reduction or elimination of valve tripping.

SUMMARY OF THE INVENTION

One aspect of the invention provides a downhole tool for circulating fluid within a well bore. The tool including a tubular housing configured with a conductor for signal passage between communication elements disposed at the ends thereof; wherein the communication elements are configured to link the housing to a downhole communication network; the housing having an outer port; a piston slidably disposed in the housing; and an inner flow bore extending through the housing and the piston including a primary fluid flow path; wherein the piston includes a first position isolating the outer port from the primary fluid flow path and a second position exposing the outer port to the primary fluid flow path to provide a bypass flow path between the inner flow bore and a well bore annulus.

One aspect of the invention provides a system for circulating fluid within a well bore. The system includes a tubular string having an inner flow bore; a housing coupled into the tubular string; the housing providing an inner fluid flow bore and configured with a port; the housing configured with a conductor for signal passage between communication elements disposed at the ends thereof; wherein the communication elements are configured to link the housing to a downhole communication network; and a piston disposed in the housing, the piston selectively moveable to isolate and expose the port to the inner fluid flow bore.

One aspect of the invention provides a method for circulating fluid within a well bore. The method includes disposing a circulation sub in the well bore, the sub configured with a conductor for signal passage between communication elements disposed at the ends thereof; wherein the communication elements are configured to link the sub to a downhole communication network; and transmitting a signal along the communication network to isolate or expose an outer port on the sub to an inner fluid flow path along the sub.

BRIEF DESCRIPTION OF THE DRAWINGS

For a more detailed description of the disclosed embodiments, reference will now be made to the accompanying drawings, wherein.

DETAILED DESCRIPTION

Figure 1:
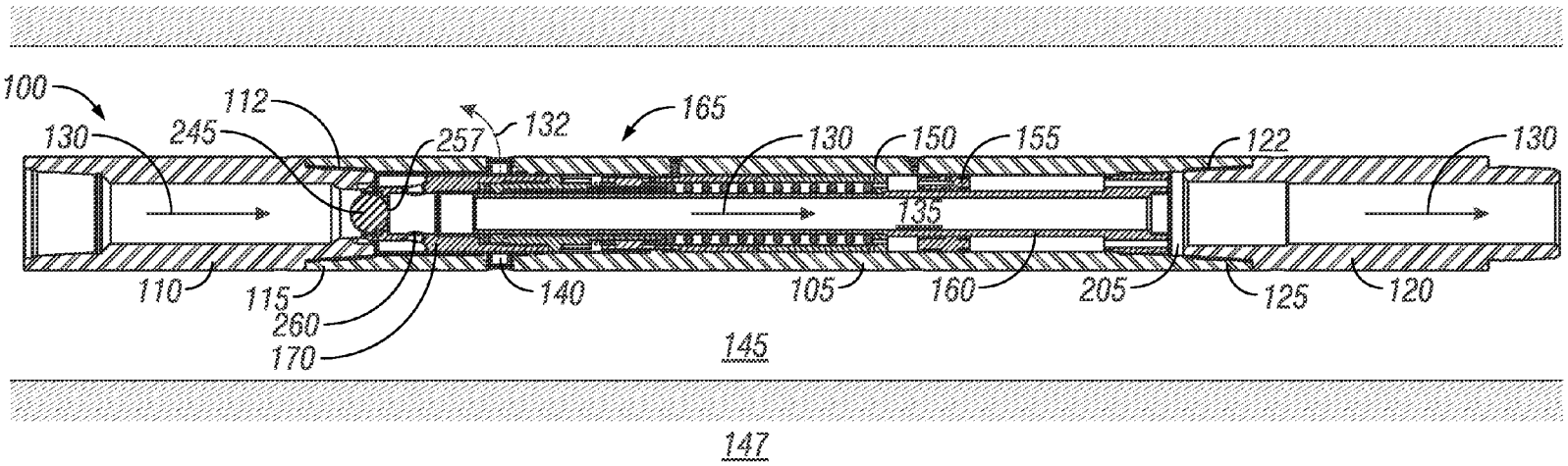
FIG. 1 schematically depicts a cross-section of an exemplary drill string portion in which the various embodiments of a circulation sub in accordance with the principles disclosed herein may be used.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

In the following discussion and in the claims, the terms "including" and "comprising" are used in an open-ended fashion, and thus should be interpreted to mean "including, but not limited to . . . ". Unless otherwise specified, any use of any form of the terms "connect", "engage", "couple", "attach", or any other term describing an interaction between elements is not meant to limit the interaction to direct interaction between the elements and may also include indirect interaction between the elements described. Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. The various characteristics mentioned above, as well as other features and characteristics described in more detail below, will be readily apparent to those skilled in the art upon reading the following detailed description of the embodiments, and by referring to the accompanying drawings.

FIG. 1 schematically depicts an exemplary drill string portion, one of many in which a circulation sub or valve and associated methods disclosed herein may be employed. Furthermore, other conveyances are contemplated by the present disclosure, such as those used in completion or workover operations and coiled tubing operations. A drill string is used for ease in detailing the various embodiments disclosed herein. A drill string portion 100 includes a circulation sub 105 coupled to a top sub 110 at its upper end 115 and to a bottom sub 120 at its lower end 125. As will be described herein, the sub 105 is selectively and continually actuatable, thus can also be referred to as a multi-opening circulation sub, or MOCS. The MOCS 105 includes a flowbore 135. The coupling of top sub 110 and bottom sub 120 to MOCS 105 establishes a primary fluid flow path 130 that also fluidicly couples to the fluid flow path in the drill string 100.

As will be described in detail below, the MOCS 105 is selectively configurable to permit fluid flow along one of multiple paths. In a first or "run-in" configuration, fluid flows along the path 130 from the top sub 110 through the MOCS 105 via flowbore 135 to the bottom sub 120 and other components that may be positioned downhole of the bottom sub 120, such as a drill bit. Alternatively, when the MOCS 105 assumes a second or "through-tool" configuration, fluid flows along the path 130 in the top sub 110, around a ball or obturating member 245 and through ports 260, and finally back to the flowbore 135 to rejoin the path 130 to the bottom sub 120 and other lower components. In a further alternative position, when the MOCS 105 assumes a third or "bypass" configuration, fluid is diverted from the path 130 through a flow path 132 in the MOCS 105 to the well bore annulus 145, located between the drill string portion 100 and the surrounding formation 147. In some embodiments, the diversion flow path through the MOCS 105 is achieved via one or more ports 140. Once in the well bore annulus 145, the fluid returns to the surface, bypassing the bottom sub 120 and other components which may be positioned downhole of the bottom sub 120. An indexing mechanism 165 guides the MOCS 105 between these various configurations or positions.

Figure 2:
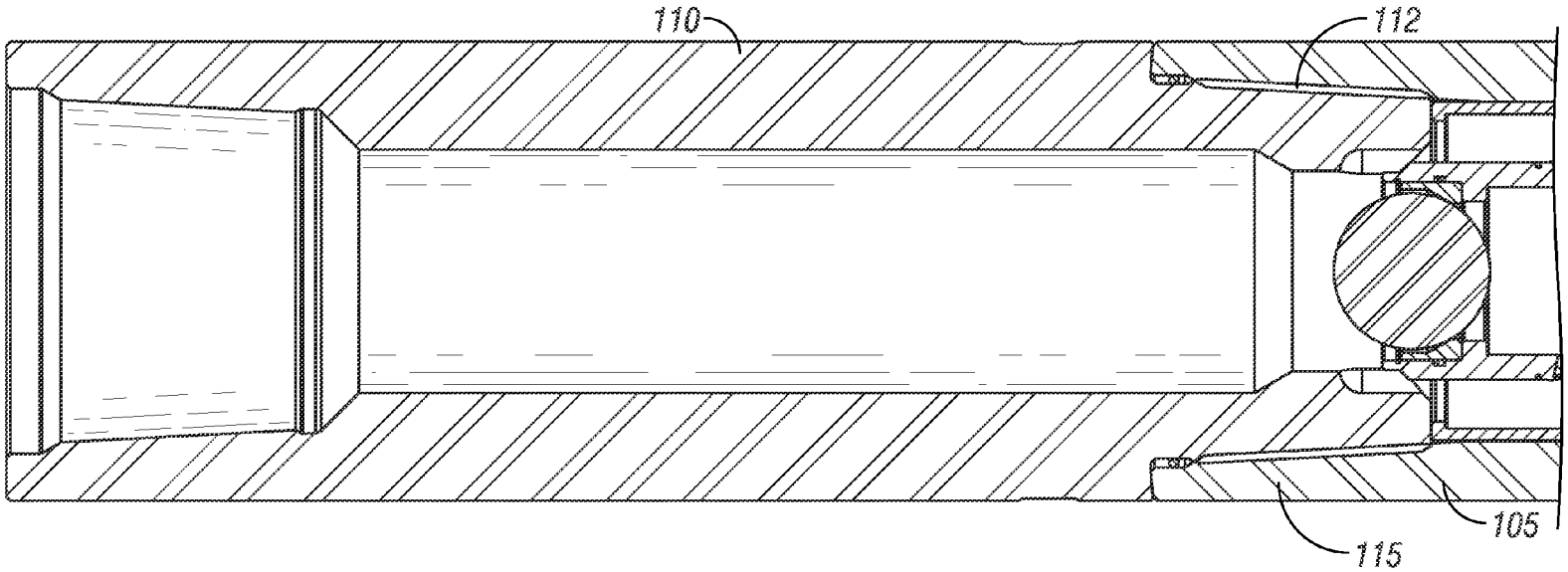
FIG. 2 is an enlarged view of the coupling between the top sub and the circulation sub shown in FIG. 1.

FIG. 2 is an enlarged view of the coupling between the top sub 110 and the MOCS 105 shown in FIG. 1. As shown, the top sub 110 and the upper end 115 of MOCS 105 are coupled via a threaded connection 112. In alternative embodiments, the components 110, 105 may be coupled by other means known in the industry.

Figure 3:
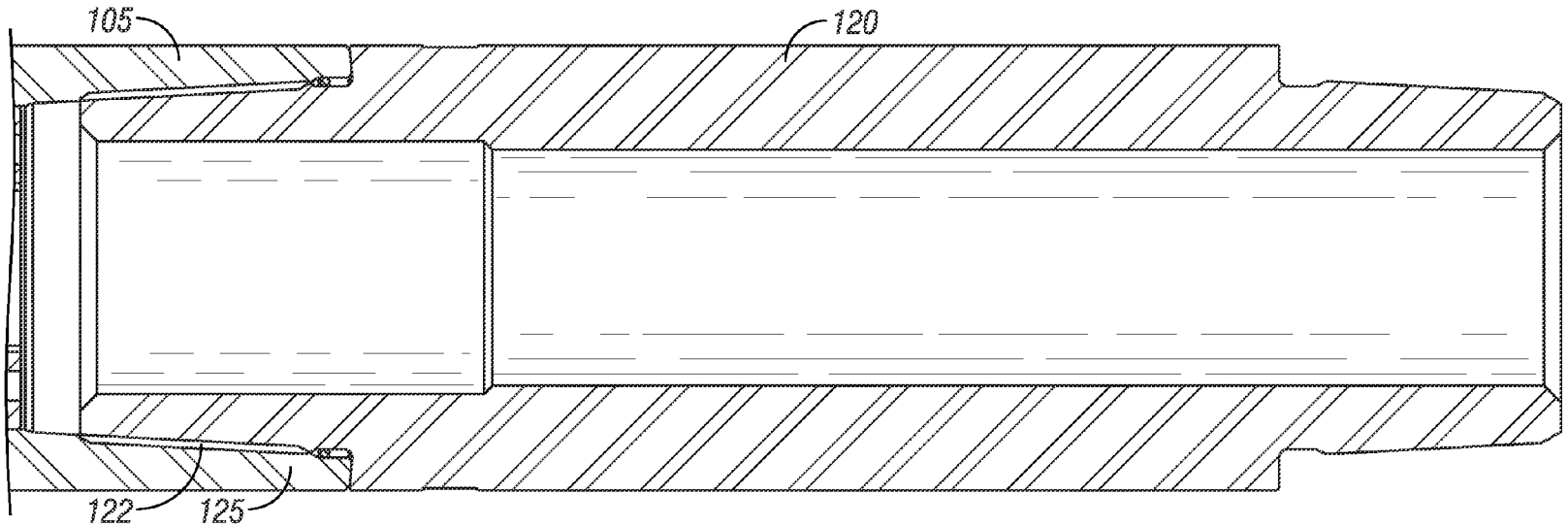
FIG. 3 is an enlarged view of the coupling between the circulation sub and the bottom sub shown in FIG. 1.

Similarly, FIG. 3 is an enlarged view of the coupling between the MOCS 105 and the bottom sub 120 shown in FIG. 1. As shown, the bottom sub 120 and the lower end 125 of MOCS 105 are coupled via a threaded connection 122. In alternative embodiments, the components 120, 105 may be coupled by other means known in the industry.

Figure 4:
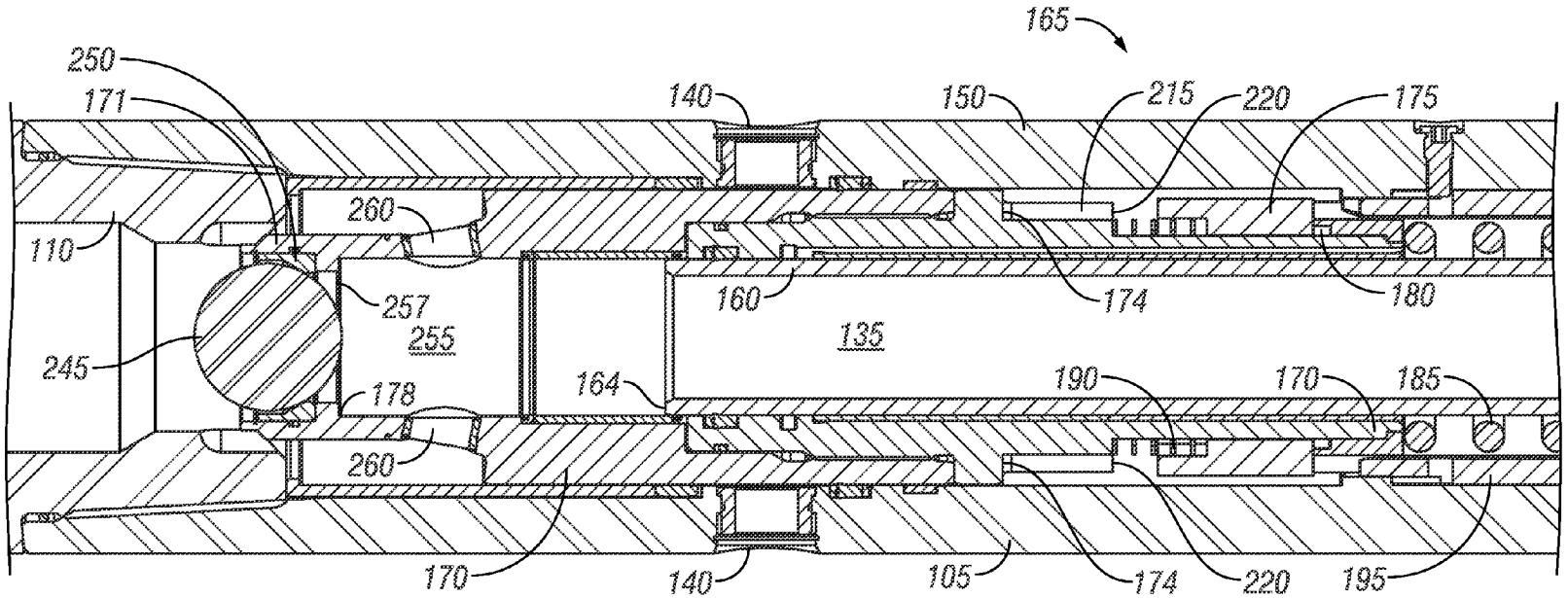
FIG. 4 is an enlarged view of the upper portion of the circulation sub shown in FIG. 1.
Figure 5:
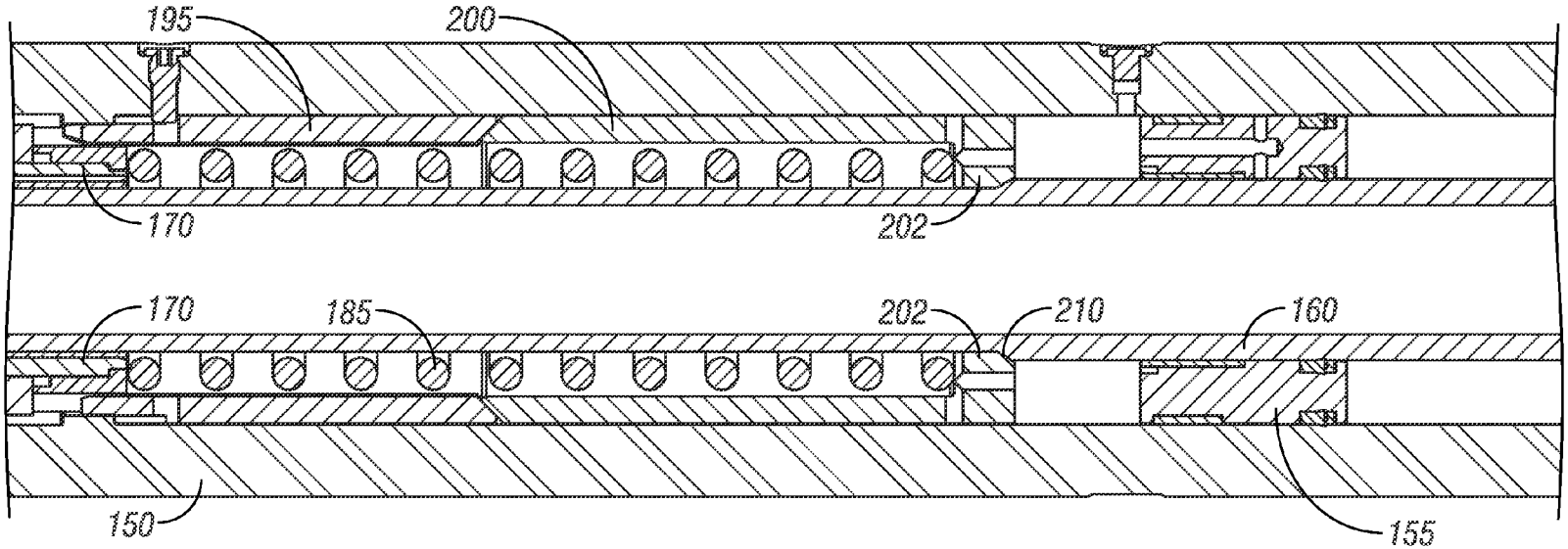
FIG. 5 is an enlarged view of the middle portion of the circulation sub shown in FIG. 1.
Figure 6:
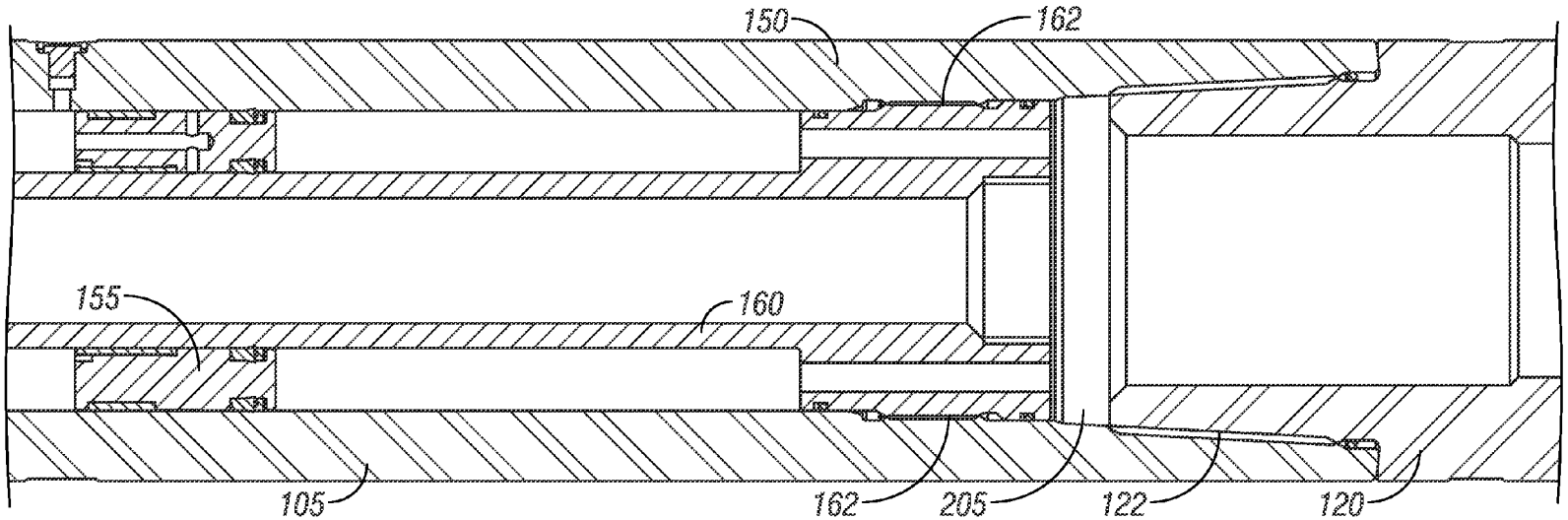
FIG. 6 is an enlarged view of the lower portion of the circulation sub shown in FIG. 1.

Returning to FIG. 1, the details of the MOCS 105 will be described with additional reference to enlarged views of the upper, middle and lower portions of the MOCS 105 as depicted in FIGS. 4, 5 and 6, respectively. Referring first to FIG. 1, the MOCS 105 includes a valve body or housing 150, a floater piston 155, a valve mandrel 160, an indexing mechanism 165 and a ported valve piston 170 slidably disposed in the housing 150. The valve body 150 of the MOCS 105 couples to the top sub 110 via threaded connection 112 and to bottom sub 120 via threaded connection 122, as described above in reference to FIGS. 2 and 3. Proceeding from the uphole end 115 to the downhole end 125 of the MOCS 105, the ported valve piston 170, the indexer 165 and the floater piston 155 are positioned concentrically within the valve body 150. The valve mandrel 160 is positioned concentrically within the ported valve piston 170, the indexer 165 and the floater piston 155 between the top sub 110 and the bottom sub 120.

The indexer 165 includes multiple interrelated components, the combination of which enables the MOCS 105 to be selectively configured to allow fluid flow through the MOCS 105 along the path 130 or to divert fluid flow from the MOCS 105 along the path 132. As will be described further herein, selective actuation between multiple configurations and flow paths is achieved continually during one trip down the borehole, and is not limited to a predetermined number of actuations. Referring briefly to FIGS. 4, 5 and 6, the indexer 165 includes an index ring 175, index teeth ring 180, a large spring 185, a small spring 190, a spline sleeve 195 and a spline spacer 200. The spline sleeve 195 is coupled to the inside of the housing 150 so that it is rotationally and axially fixed relative to the housing 150. The index ring 175 is rotationally and axially moveable relative to the housing 150 and the piston 170, with the small spring 190 biasing the index ring 175 toward the spline sleeve 195. The large spring 185 provides an upward biasing force on the piston 170. Further relationships and operation of the indexer 165 are described below.

Figure 7:
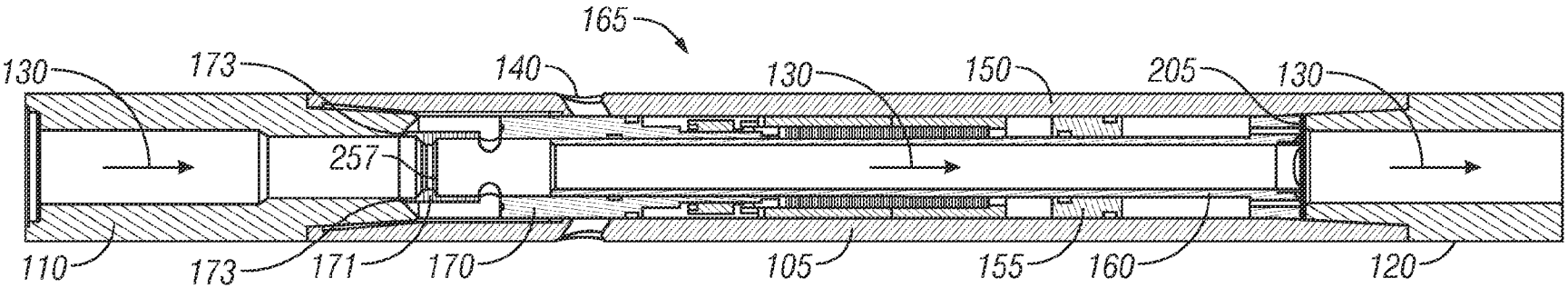
FIG. 7 depicts the circulation sub of FIG. 1 in a "run-in" configuration.
Figure 8:
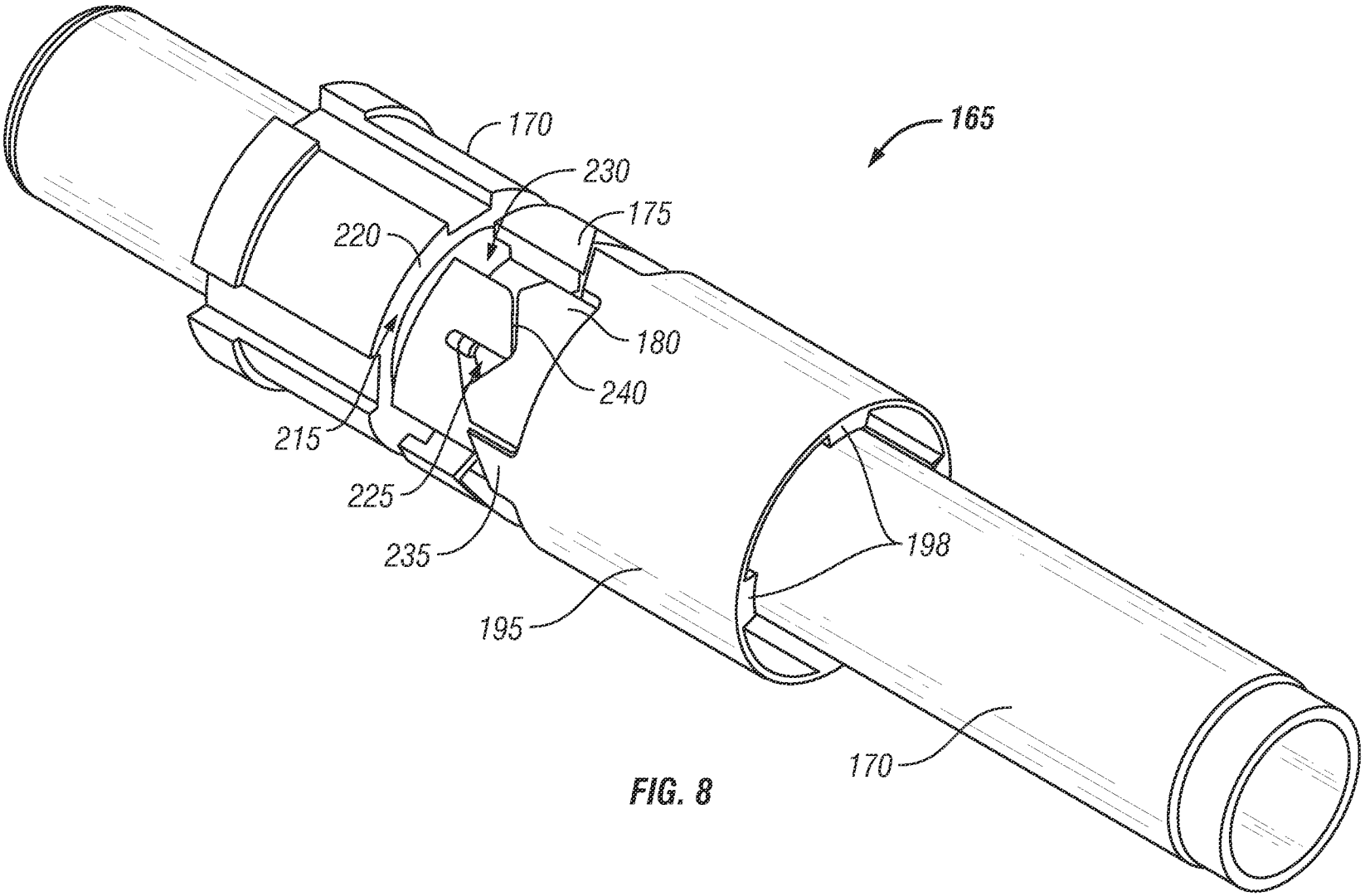
FIG. 8 is a perspective view of an indexer of the circulation sub of FIG. 7 in a "run-in" configuration.
Figure 9:
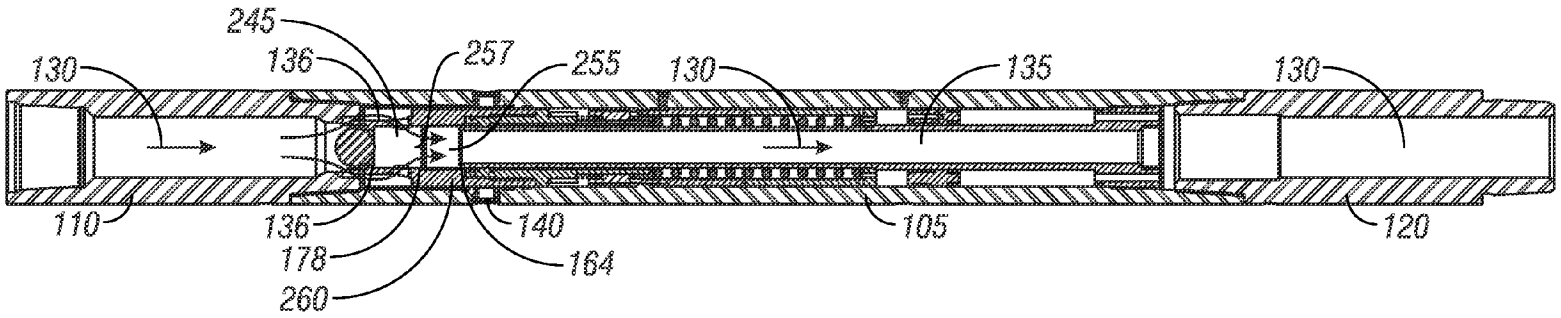
FIG. 9 depicts the circulation sub of FIG. 1 in a "through-tool" configuration.
Figure 10:
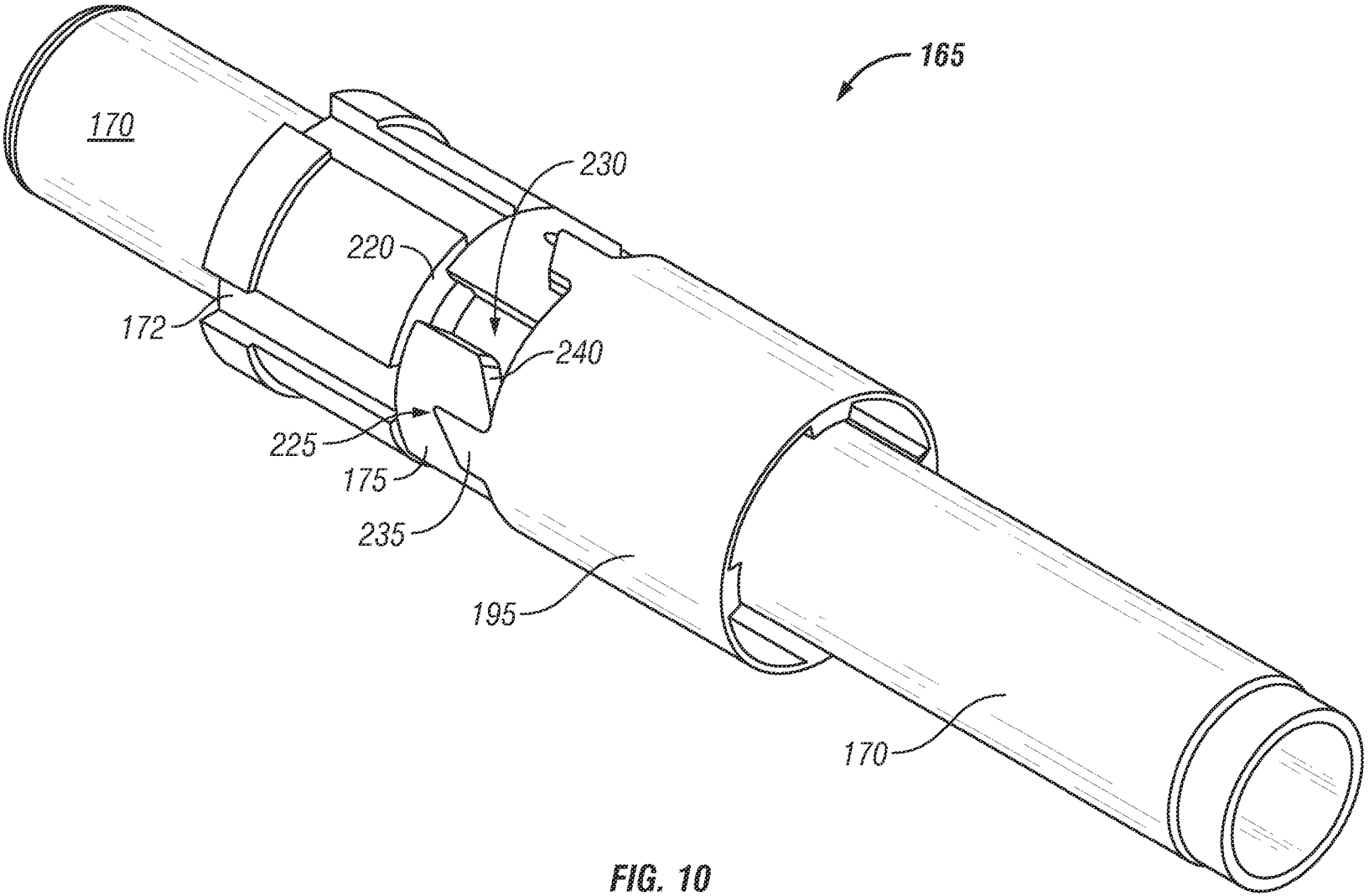
FIG. 10 is a perspective view of the indexer of the circulation sub of FIG. 9 in a "through-tool" configuration.
Figure 11:
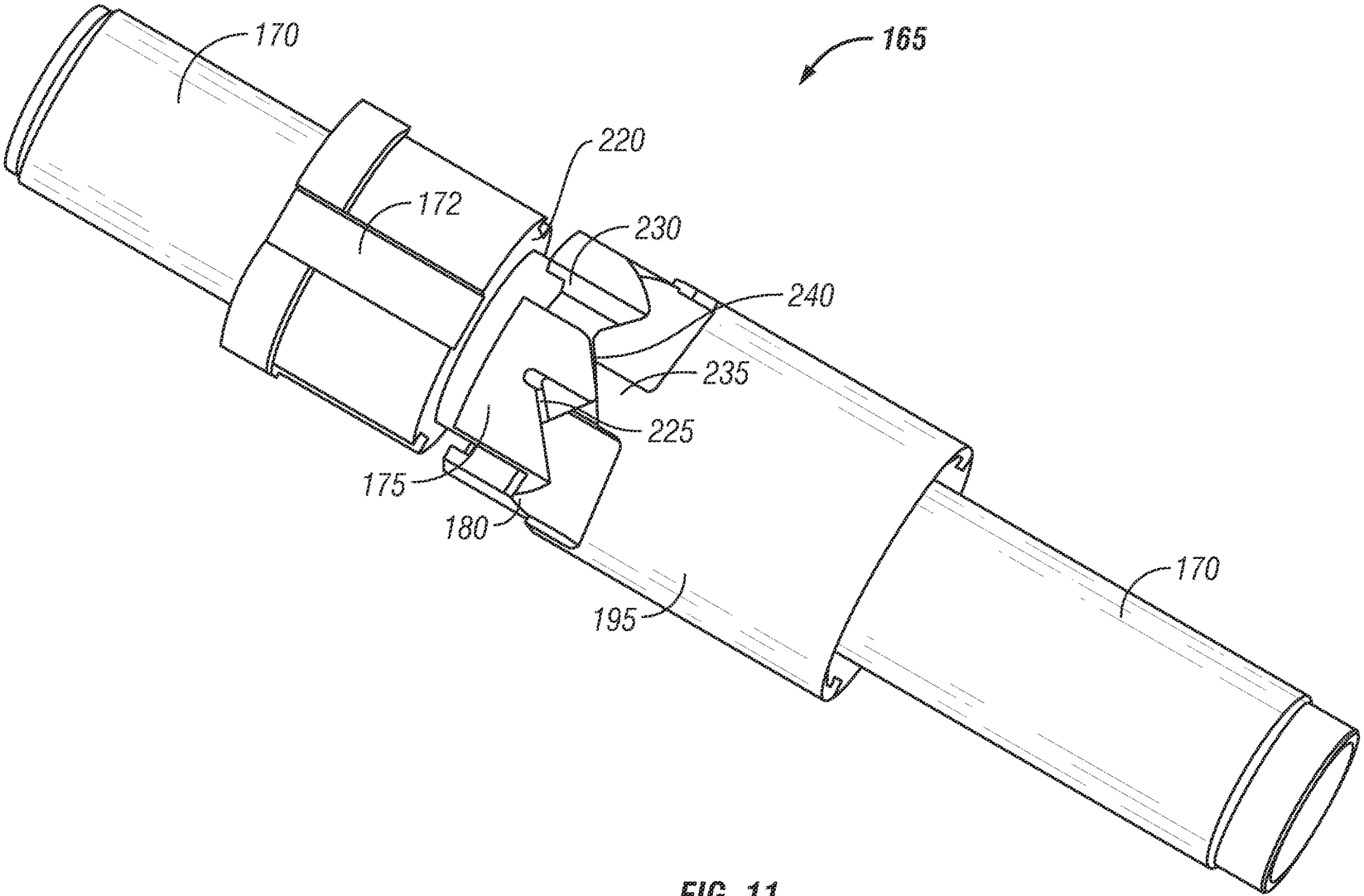
FIG. 11 is a perspective view of the indexer of FIG. 10 in a reset position.
Figure 12:
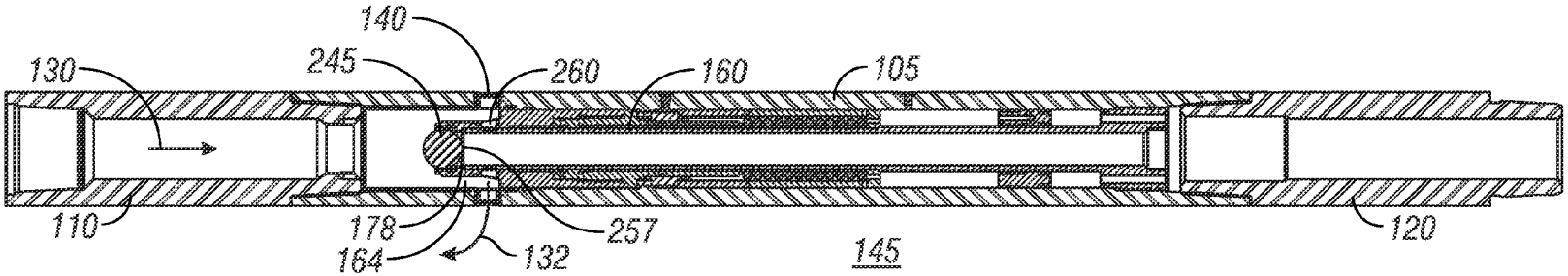
FIG. 12 depicts the circulation sub of FIG. 1 in a "bypass" configuration.
Figure 13:
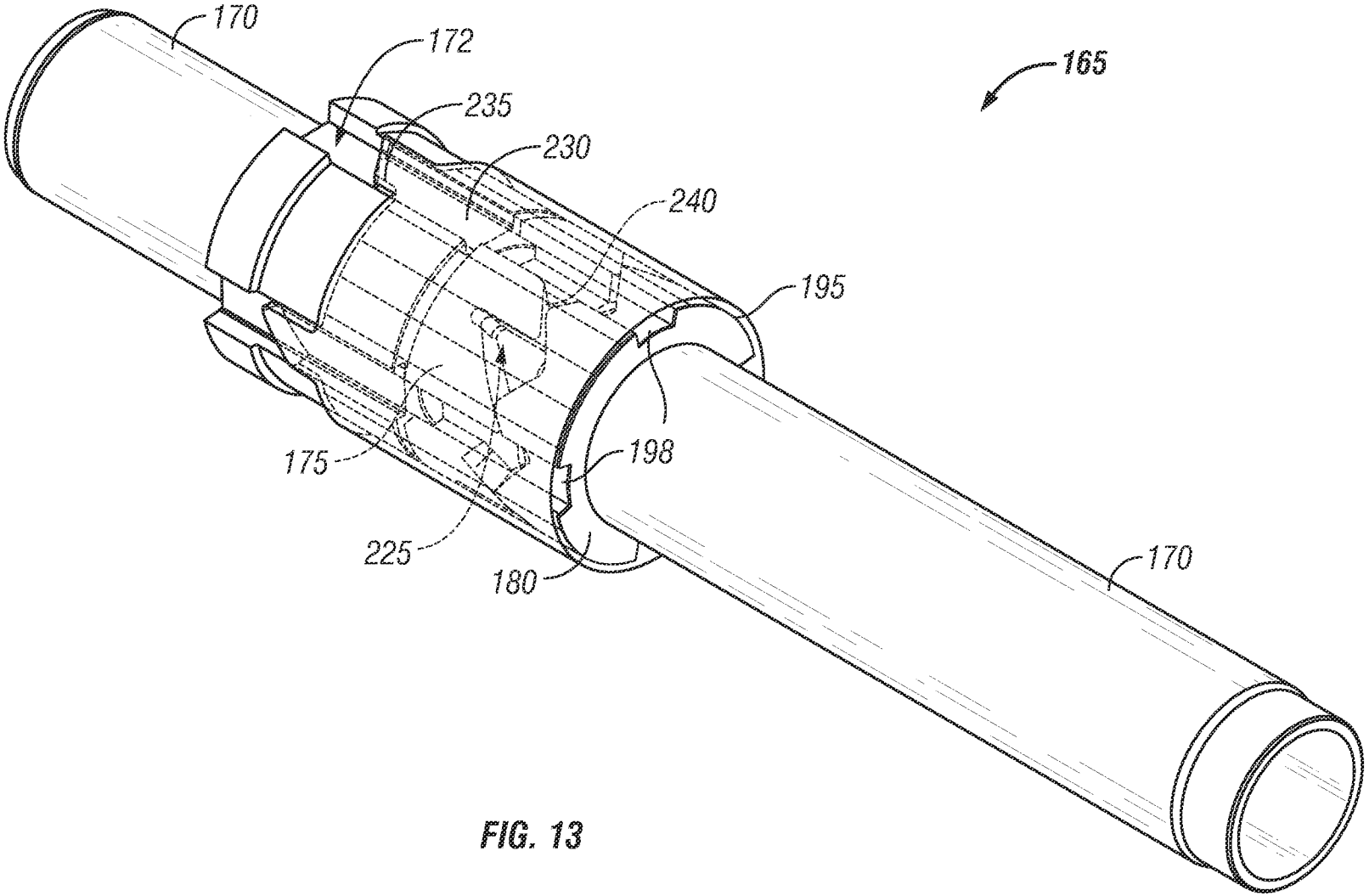
FIG. 13 is a perspective view of the indexer of the circulation sub of FIG. 12 in a "bypass" configuration.

The manner in which the components of the MOCS 105 move relative to each other is best understood by considering the various configurations that the MOCS 105 can assume. In the embodiments illustrated by FIGS. 1 through 24, there are multiple configurations that the MOCS 105 can assume to execute multiple flow paths: the run-in configuration; the through-tool configuration; the bypass configuration; and intermittent modes. The run-in configuration refers to the configuration of the MOCS 105 as it is tripped downhole and allows drilling fluid to flow along the path 130, as illustrated by FIGS. 7 and 8. The through-tool configuration of the MOCS 105 allows drilling fluid to continue flowing along the path 130, with only a slight deviation around the obturating member 245 and through the ports 260. This flow path is illustrated in FIGS. 9 and 10. The bypass configuration of the MOCS 105 diverts drilling fluid from the path 130 in upper sub 110 to the well bore annulus 145 via the path 132 through the ports 140. The bypass configuration of the MOCS 105 is illustrated by FIGS. 12 and 13.

FIG. 7 depicts the MOCS 105 in the initial run-in configuration. In this configuration, the valve mandrel 160 is positioned between the ported valve piston 170 and the bottom sub 120 with a small amount of clearance 205, visible in FIGS. 1, 6 and 7, between the valve mandrel 160 and the bottom sub 120. The upper portion 171 of the valve piston 170 is shouldered at 173 while the body of the valve piston 170 blocks or isolates the annulus ports 140, thereby providing an unencumbered primary flow path 130 through the tool. When the MOCS 105 is tripped downhole, the indexer 165 also assumes an initial run-in configuration, as depicted in FIG. 8.

Referring now to FIG. 8, the index ring 175, the index teeth ring 180, and the spline sleeve 195 are positioned concentrically about the ported valve piston 170 with a clearance 215 between a shoulder 220 of the ported valve piston 170 and the index ring 175. The index ring 175 includes one or more short slots 225 distributed about its circumference. The index ring 175 also includes one or more long slots 230 distributed about its circumference in alternating positions with the short slots 225. Between each short slot 225 and each long slot 230, the lower end 240 of the index ring 175 is angular to form a cam surface. The index ring 175 may also be referred to as an indexing slot.

The spline sleeve 195 includes a plurality of angled tabs 235 extending from an upper end of the spline sleeve 195, with corresponding splines 198 extending along the inner surface of the spline sleeve 195. Each tab 235 and spline 198 of spline sleeve 195 is sized to fit into each short slot 225 and each long slot 230 of the index ring 175. When the indexer 165 assumes the run-in configuration, as shown in FIG. 8, each tab 235 is engaged with an angular surface 240 between the short slots 225 and long slots 230 to form mating cam surfaces between the spline sleeve 195 and the index ring 175.

After the MOCS 105 is positioned downhole in the run-in configuration, it may become desirable to divert the fluid flow 130 to the annulus 145. First, the MOCS 105 must be actuated. Referring again to FIG. 1, a ball 245 is dropped or released into the drill string coupled to the top sub 110 of the tool 100. The ball 245 is carried by drilling fluid along the drill string through the top sub 110 to the MOCS 105 where, referring now to FIG. 4, the ball 245 lands in a ball seat 250 in the upper end 171 of the ported valve piston 170. Once seated, the ball 245 obstructs the flow of drilling fluid through inlet 257 of the ported valve piston 170 and provides a pressure differential that actuates the MOCS 105. Although the ball 245 is employed to actuate the MOCS 105 in this exemplary embodiment, other obturating members known in the industry, for example, a dart, may be alternatively used to actuate the MOCS 105.

Referring now to FIG. 5, in response to the pressure load from the now-obstructed drilling fluid flow, the ported valve piston 170 translates downward, compressing the larger spring 185 against spline spacer sleeve 200 at a shoulder 202. The spline spacer sleeve 200 abuts a shoulder 210 of the valve mandrel 160. Thus, the compression load from the ported valve piston 170 is transferred through the larger spring 185 and the spline spacer sleeve 200 to the valve mandrel 160, which is threaded into the valve body 150 at 162 above the clearance 205, as shown in FIG. 6. The valve mandrel 160, connected at the threads 162, is torqued up and does not move further during operation of the MOCS 105.

Continued translation of the ported valve piston 170 downward under pressure load from the drilling fluid also compresses the small spring 190 (FIG. 4) against the index ring 175 and eventually closes the clearance 215 (FIG. 8) between the shoulder 220 of the ported valve piston 170 and the index ring 175. Referring to FIG. 8, once the clearance 215 is closed and the shoulder 220 of the ported valve piston 170 abuts the index ring 175, continued translation of the ported valve piston 170 downward causes the lower angular surfaces 240 of the index ring 175 to slide along the mating angled tabs 235 of the spline sleeve 195. As the surfaces 240 slide along the angled tabs 235, the index ring 175 rotates about the ported valve piston 170 relative to the spline sleeve 195 until each tab 235 of the spline sleeve 195 fully engages an angled short slot 225 of the index ring 175. This completes actuation of the MOCS 105, as shown in FIG. 10.

Referring now to FIG. 10, once each tab 235 of the spline sleeve 195 fully engages a short slot 225 of the index ring 175, the index ring 175 is prevented from rotating and the ported valve piston 170 is prevented by the index ring 175 from translating further downward about the valve mandrel 160. This configuration of the indexer 165 corresponds to the through-tool configuration of the MOCS 105 as shown in FIG. 9. The index ring 175 is rotationally constrained by the interlocking tab 235 and slot 225 arrangement, and axially constrained by the abutting piston shoulder 220 and spline sleeve 195 (which is coupled to the body 150).

Referring now to FIG. 9, the ball 245 continues to obstruct the flow of drilling fluid through the inlet 257 of the ported valve piston 170. The downwardly shifted valve piston 170 also continues to isolate the annulus ports 140 and prevent fluid communication between the inner fluid flow 130 and the well bore annulus 145. Thus, the drilling fluid flows around the ball 245 and passes through one or more inner diameter (ID) ports 260 (see also FIG. 4) in the ported valve piston 170 to define a secondary inner flow path as shown by arrows 136. Once through the ID ports 260, the drilling fluid flows through a flowbore 255 of the ported valve piston 170 and continues along the path 130 through the flowbore 135 of the MOCS 105 to the bottom sub 120 and any components that may be positioned downhole of the bottom sub 120. Thus, with the MOCS 105 in the through-tool configuration, the drilling fluid is permitted to flow from the top sub 110 through the tool 105 and to the bottom sub 120.

When it is desired to divert all or part of the flow of drilling fluid to the bottom sub 120 and/or any components positioned downhole of the bottom sub 120, such as the mud motor or drill bit, the MOCS 105 may be selectively reconfigured from the through-tool configuration to the bypass configuration. To reconfigure the MOCS 105 in this manner, the flow of drilling fluid to the MOCS 105 is first reduced or discontinued to allow the indexer 165 to reset. The flow rate reduction of the drilling fluid removes the downward pressure load on the ported valve piston 170. In the absence of this pressure load, the large spring 185 expands, causing the index ring 175 and the ported valve piston 170 to translate upward (FIG. 4). At the same time, the absence of the pressure load also allows the small spring 190 to expand, causing the ported valve piston 170 to translate upward relative to the index ring 175 (FIG. 4). Once the small spring 190 and the large spring 185 have expanded, the indexer 165 is reset to a position shown in FIG. 11. Unlike the position shown in FIG. 8, the index ring 175 is now rotated slightly and the respective cam surfaces of the index ring end 240 and the tabs 235 are aligned to guide the spline sleeve 195 into the long slots 230 rather than the short slots 225.

After the indexer 165 is reset, the flow of drilling fluid through the drill string portion 100 and the top sub 110 to the MOCS 105 may be increased or resumed to cause the MOCS 105 and the indexer 165 to assume their bypass configurations. As before, the pressure load of the drilling fluid acting on the obstructed ported valve piston 170 causes translation of the piston 170 downward, compressing the small spring 190 (FIG. 4) against the index ring 175 and eventually closing the clearance 215 (FIG. 8) between the shoulder 220 of the ported valve piston 170 and the index ring 175.

Once the clearance 215 is closed and the shoulder 220 of the ported valve piston 170 abuts the index ring 175, continued translation of the ported valve piston 170 downward causes angled surfaces 240 of index ring 175 to slide along the angled tabs 235 of the spline sleeve 195. As the angled surfaces 240 slide along tabs 235, the index ring 175 rotates from the position shown in FIG. 11 about the piston 170 relative to the spline sleeve 195 until each tab 235 engages a long slot 230 of the index ring 175. As shown in FIG. 11, the tabs 235 are aligned with slots 172 on the valve piston 170. After each tab 235 of the spline sleeve 195 engages a long slot 230 of the index ring 175, the long slots 230 become axially aligned with the tabs 235 and the slots 172, and the index ring 175 is prevented from rotating further.

Referring now to FIG. 13, the pressure-loaded valve piston 170 continues to translate downward relative to the fixed spline sleeve 195 because the tabs 235 are aligned with the long slots 230 and the slots 172. The long slots 230 and the slots 172 are guided around the splines 198 until the valve piston 170 reaches the position in the spline sleeve 195 as shown in FIG. 13, wherein a valve piston shoulder 178 (FIGS. 4, 9 and 12) has contacted a valve mandrel shoulder 164 to bottom out the valve piston 170 on the mandrel 160. This configuration of the indexer 165 corresponds to the bypass configuration of the MOCS 105 as shown in FIG. 12.

Referring to FIG. 12, when the MOCS 105 assumes its bypass configuration, the ball 245 continues to obstruct the flow of drilling fluid through the inlet 257 of the ported valve piston 170. Furthermore, the ID ports 260 of the ported valve piston 170 have been disposed below the upper end of the valve mandrel 160 such that the valve mandrel 160 now blocks the ports 260. Simultaneously, the outer diameter (OD) ports 140 in the valve body 150 are exposed to the fluid flow around the ball 245 by the downwardly shifted valve piston 170. With the inlet 257 to the ported valve piston 170 obstructed by the ball 245 and the ports 260 blocked by the valve mandrel 160, the drilling fluid flows around the ball 245 and is diverted from the path 130 to the path 132 through the ports 140 into the well bore annulus 145, thereby bypassing the bottom sub 120 and any components that may be positioned downhole of the bottom sub 120.

To reestablish the flow of drilling fluid along the path 130 through the flowbore 135 of the MOCS 105, the drilling fluid flow is discontinued to allow the indexer 165 to reset, as described above, to the position of FIG. 8. After the indexer 165 is reset, the drilling fluid flow is then resumed to cause the indexer 165 to rotate and lock into its through-tool configuration (FIG. 10) and the MOCS 105 to assume its through-tool configuration (FIG. 9), meaning the ported valve piston 170 is translated relative to the valve mandrel 160 such that the ID ports 260 are no longer blocked by the valve mandrel 160 and the ports 140 are no longer exposed. Drilling fluid is then permitted to flow along the path 130/136 through MOCS 105 to the bottom sub 120.

After a period of time, the flow of drilling fluid may be again diverted from the path 130 through the MOCS 105 to the path 132 through ports 140 of the valve body 150 into the well bore annulus 145. Again, the drilling fluid flow is discontinued to allow the indexer 165 to reset to the position of FIG. 11. After the indexer 165 is reset, the drilling fluid is then resumed to cause the indexer 165 to rotate and lock into its bypass configuration (FIG. 13) and the MOCS 105 to assume its bypass configuration (FIG. 12), meaning the ported valve piston 170 is translated relative to the valve mandrel 160 such that the ID ports 260 are blocked by the valve mandrel 160 and the OD ports 140 in the valve body 150 are exposed. Drilling fluid is then diverted from the path 130 to the path 132 through the OD 140 ports to the well bore annulus 145.

During movements in the embodiments described herein, the index teeth ring 180 serves several purposes. In the reset positions of the indexer 165, such as in FIGS. 8 and 11, the index teeth ring 180 prevents the valve piston 170 from rotating because the splines 198 are always engaged with the slots in the index teeth ring 180 and the teeth of the index teeth ring 180 engage the angled cam surfaces of the index ring 175. Furthermore, the index teeth ring 180 shifts the index ring 175 to the next position when the index ring 175 is returned by the force from the small spring 190. In some embodiments, the index teeth ring 180 may be kept from rotating or moving axially by cap screws. An axial force applied to the index teeth ring 180 may be received by a step in the index teeth ring 180, while an opposing axial force from the large spring 185 counteracts this force and forces the index teeth ring 180 onto the valve piston 170 such that the cap screws experience little net axial force.

As described above, the MOCS 105 may be selectively configured either in its through-tool configuration or its bypass configuration by interrupting and then reestablishing the flow of drilling fluid to the MOCS 105. Moreover, the MOCS 105 may be reconfigured in this manner an unlimited number of times without the need to return the tool to the surface. This allows significant time and cost reductions for well bore operations involving the MOCS 105, as compared to those associated with operations which employ conventional circulating subs.

In the exemplary embodiments of the MOCS 105 illustrated in FIGS. 1 through 13, the MOCS 105 is configurable in either of two configurations after actuation via the indexer 165. However, in other embodiments, the MOCS 105 may assume three or more post-actuation configurations by including additional slots of differing lengths along the circumference of the index ring 175 of the indexer 165.

In the exemplary embodiments of the MOCS 105 illustrated in FIGS. 1 through 24, the MOCS 105 is configurable by the application of a pressure load from the drilling fluid. However, in other embodiments, the MOCS 105 may be configurable by mechanical means, including, for example, a wireline physically coupled to the ported valve piston 170 and configured to translate the ported valve piston 170 as needed. Alternatively, the valve piston may receive a heavy mechanical load, such as a heavy bar dropped onto the top of the valve piston. Other means for actuating the MOCS and indexer arrangement described herein are consistent with the various embodiments.

The embodiments described herein can be used in environments including fluids with lost circulation material. For example, the arrangement of the ID ports 260 and the OD ports 140 prevent any superfluous spaces from acting as stagnant flow areas for particles to collect and plug the tool. Further, in some embodiments, the indexer 165 is placed in an oil chamber. Referring to FIG. 4, an oil chamber extends from a location between the OD ports 140 and point 174 down to the floater piston 155 of FIG. 5, and surrounds the indexer 165 including the springs 185, 190. The indexer 165 is not exposed to well fluids. Consequently, the internal components of the MOCS 105 can be hydrostatically balanced as well as differential pressure balanced, allowing the MOCS 105 to only shift positions when a predetermined flow rate has been reached.

Figure 14:
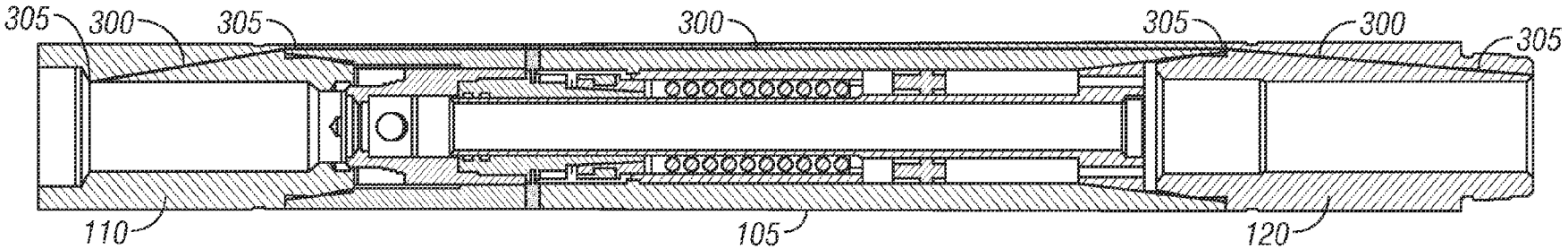
FIG. 14 schematically depicts a cross-section of an exemplary wired drill string portion in which the various embodiments of a circulation sub in accordance with the principles disclosed herein may be used.

Aspects of the invention also include MOCS 105 configured for operation as part of a wired telemetry network. FIG. 14 shows a MOCS 105 aspect of the invention configured with conductors 300 traversing the entire length of the tool through the top sub 110, circulation sub 105, and bottom sub 120. The conductor(s) 300 may be selected from the group consisting of coaxial cables, copper wires, optical fiber cables, triaxial cables, and twisted pairs of wire. The ends of the subs 105, 110, 120 are configured to communicate within a downhole network as described below.

Figure 15:
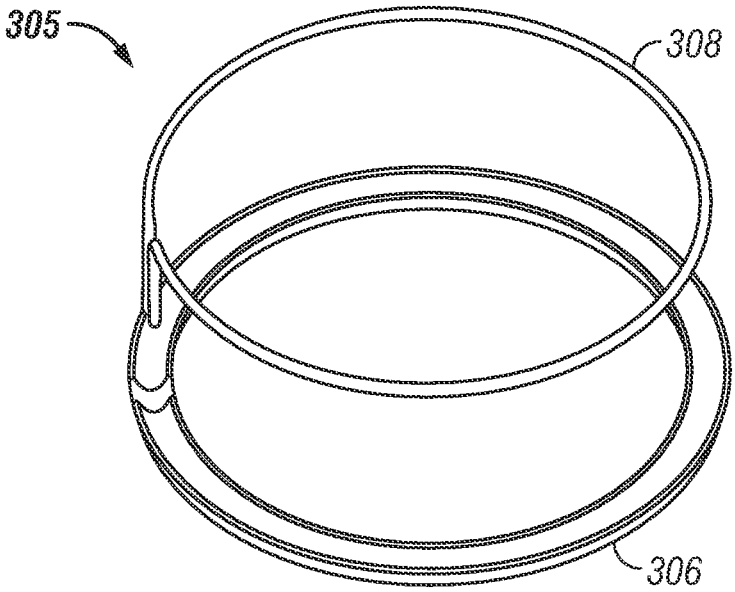
FIG. 15 is an exploded perspective view of a communication element in accordance with aspects of the invention.

Communication elements 305 allow the transfer of power and/or data between the sub connections and through the MOCS 105. The communication elements 305 may be selected from the group consisting of inductive couplers, direct electrical contacts, optical couplers, and combinations thereof. FIG. 15 shows an inductive coupler embodiment of a communication element 305 having a magnetically conducting, electrically insulating element 306 and an electrically conducting coil 308 accommodated within the element 306. The electrically conducting coil 308 may be formed from one or more coil-turns of an electrically conducting material such as a metal wire and configured as described in any of U.S. Pat. Nos. 6,670,880, 7,248,177, 6,913,093, 7,093,654, 7,190,280, 7,261,154, 6,929,493 and 6,945,802 (incorporated herein by reference for all that they disclose).

An aspect of the invention may be configured with communication elements 305 comprising inductive couplers for data transmission. The MOCS 105 aspect shown in FIG. 14 may include communication elements 305 consisting of inductive couplers disposed in recesses formed in the subs similar to the configurations disclosed in any of U.S. Pat. Nos. 6,670,880, 7,248,177, 6,913,093, 7,093,654, 7,190,280, 7,261,154, 6,929,493 and 6,945,802.

Figure 16:
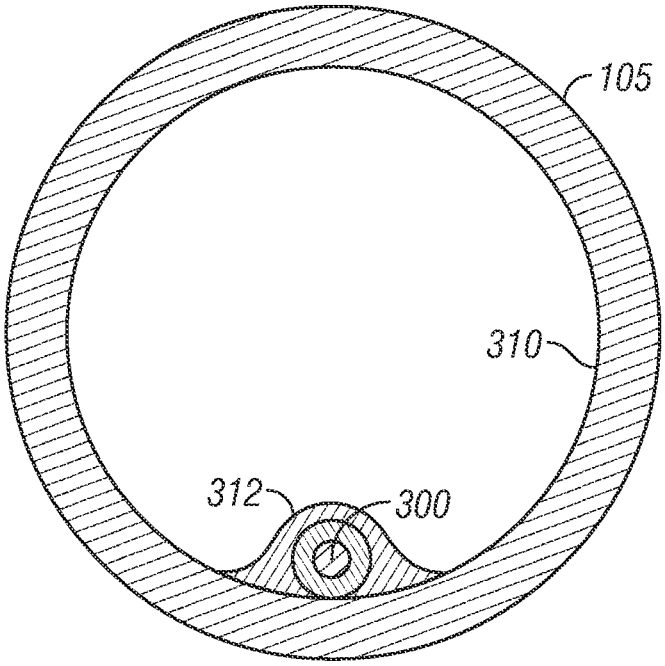
FIG. 16 is a cross-sectional view of a wired sub end in accordance with aspects of the invention.

The conductor 300 may be disposed through a hole formed in the walls of the subs 105, 110, 120. In some aspects, the conductor 300 may be disposed part way within the sub walls and part way through the inside bore of the subs. FIG. 16 shows an end of one of the subs 105, 110, 120 having the conductor 300 inserted along the ID of the pipe 310. In some aspects, a coating 312 may be applied to secure the conductor 300 in place. In this way, the conductor 300 will not affect the operation of the MOCS tool. The coating 312 should have good adhesion to both the metal of the pipe 310 and any insulating material surrounding the conductor 300. Useable coatings 312 include, for example, a polymeric material selected from the group consisting of natural or synthetic rubbers, epoxies, or urethanes. Conductors 300 may be disposed on the subs using any suitable means as known in the art.

Figure 17:
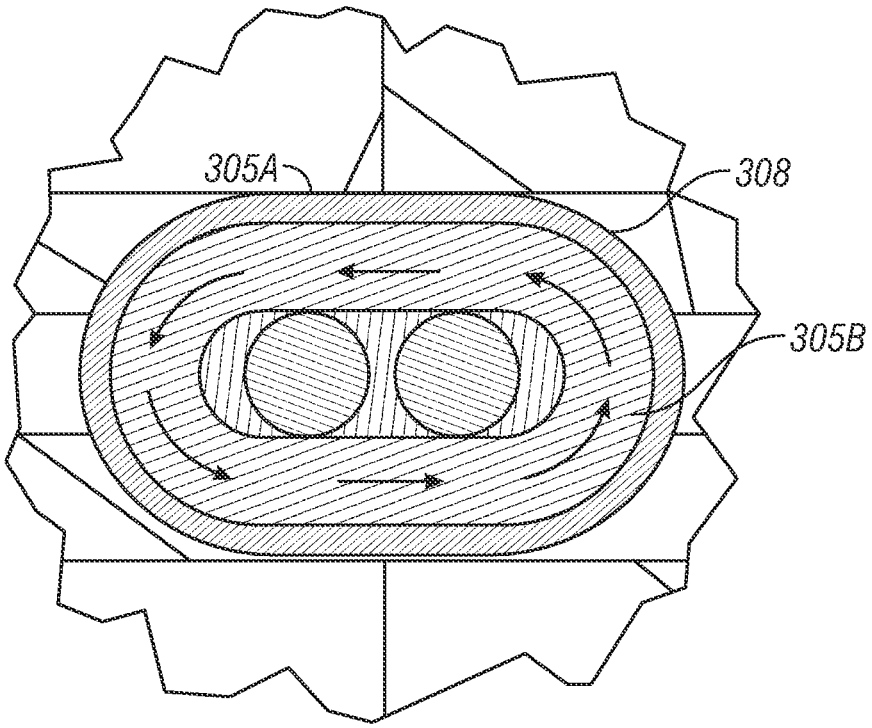
FIG. 17 is an enlarged cross-section of a connection between communication elements of a sub connection in accordance with aspects of the invention.

Returning to FIG. 14, a data/power signal may be transmitted along the MOCS 105 from one end of the tool through the conductor(s) 300 to the other end across the communication elements 305. As shown in FIG. 17, when a first inductive coupler element 305A is mated to a second similar inductive coupler element 305B, a magnetic flux passes between the two according to the data signal in a first electrically conducting coil and induces a similar data signal in a second electrically conducting coil. Such signal passage across a MOCS 105 configured with inductive couplers is further described in U.S. Pat. Nos. 6,670,880, 7,248,177, 6,913,093, 7,093,654, 7,190,280, 7,261,154, 6,929,493 and 6,945,802.

Figure 18:
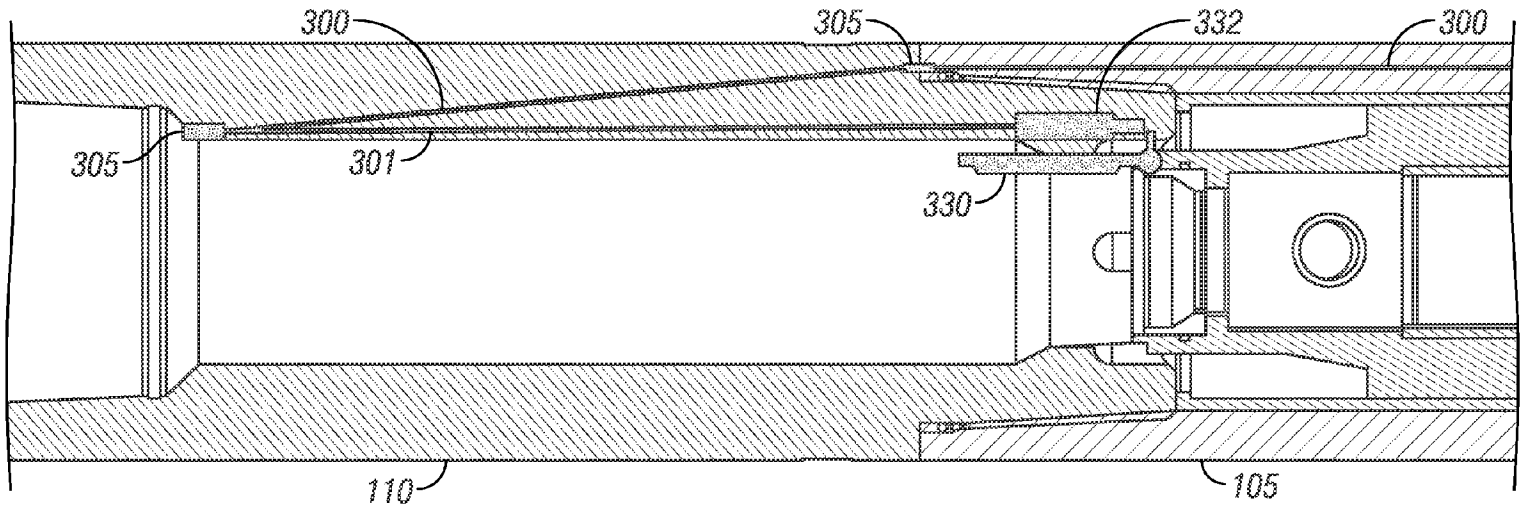
FIG. 18 is an enlarged view of a wired circulation sub in accordance with aspects of the invention.

The configuration of a wired MOCS tool allows for the implementation of novel tool applications. For example, aspects of the invention may be configured for real-time electrical actuation without the use of a drop ball. FIG. 18 shows a wired MOCS aspect of the invention. In this embodiment, the upper sub 110 is configured with an electronically controlled valve 330 (e.g., ball valve, throttle valve, flapper valve) in the ID of the sub 110. The valve 330 may be actuated remotely by a signal communicated through conductor 300 to conductor 301 to trigger an actuator 332 (e.g., solenoid, servo, motor). The actuator 332 can be activated to block flow through the tool and build pressure in front of the valve 330 to create a flow restriction to shift the valve position to operate the MOCS 105 in one of the desired configurations described herein. Once the valve 330 is in the desired position it can be locked there until the operator wishes to regulate the flow using the valve to cycle the tool to switch to another setting. The actuation signal for the actuator 332 can be distinguished from other signals transmitted along the conductors 300, 301 using conventional communication protocols (e.g., DSP, frequency multiplexing, etc.). It will be appreciated by those skilled in the art that conventional components may be used to implement the valve 332 and actuator 332 as known in the art.

Figure 19:
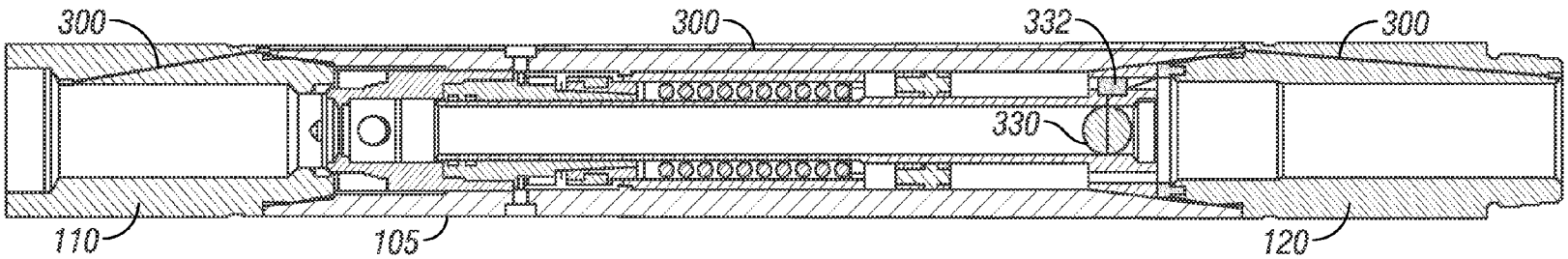
FIG. 19 schematically depicts a cross-section of an exemplary wired circulation sub in accordance with aspects of the invention.
Figure 20:
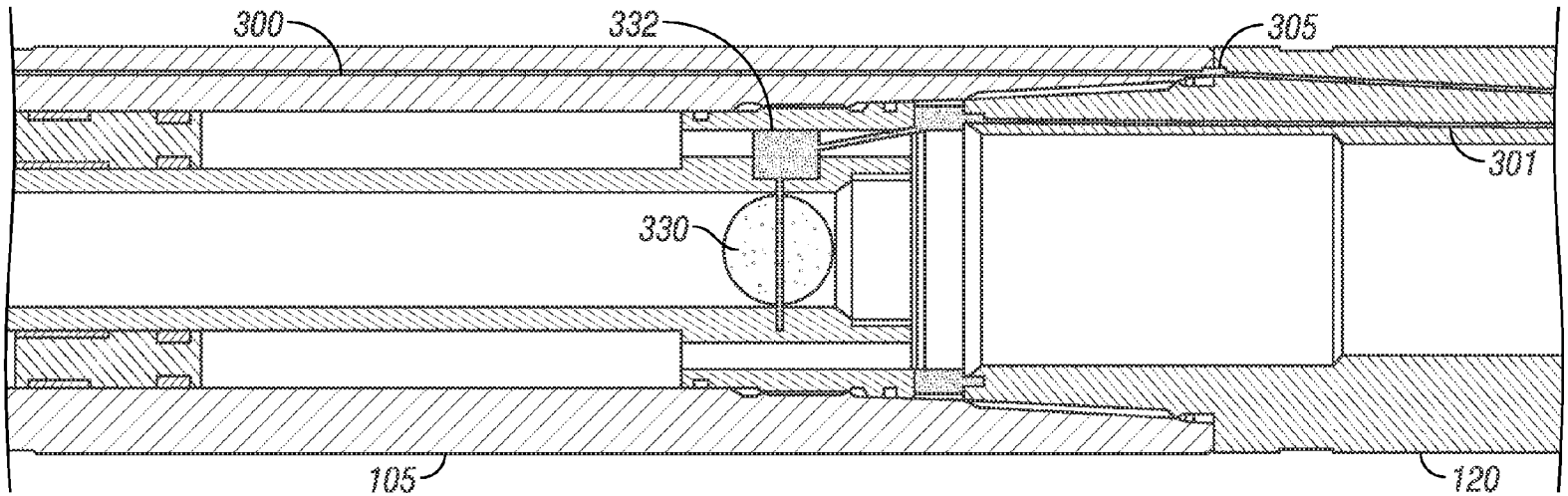
FIG. 20 is an enlarged view of the lower portion of the circulation sub shown in FIG. 19.

FIG. 19 shows another MOCS aspect of the invention. In this aspect, the valve 330 is disposed near one end of the MOCS 105 sub. FIG. 20 is an enlarged view of this aspect. In this implementation, the valve 330 may also be actuated remotely by a signal communicated through conductor 300 to conductor 301 to trigger the actuator 332. The actuator 332 can be activated to rotate to block or allow flow through the tool ID Once the valve 330 is in the desired position it can be locked there until the operator wishes to cycle the tool again to switch to another desired setting.

Figure 21:
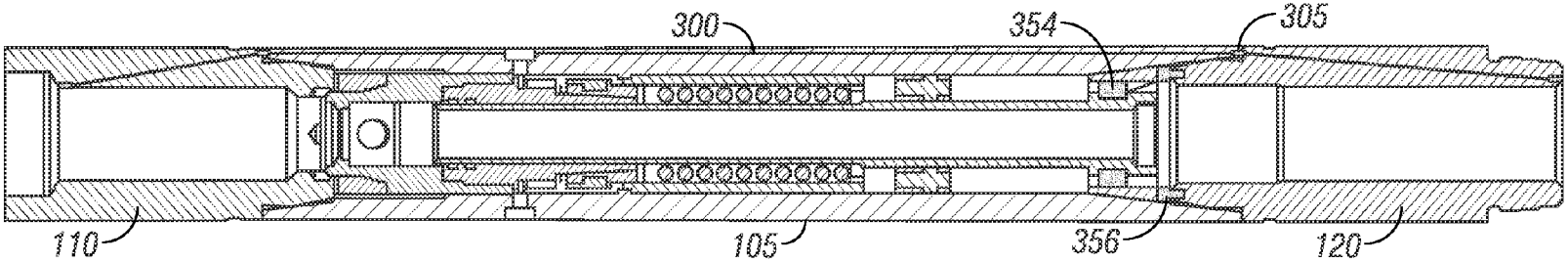
FIG. 21 schematically depicts a cross-section of an exemplary wired circulation sub in accordance with aspects of the invention.
Figure 22:
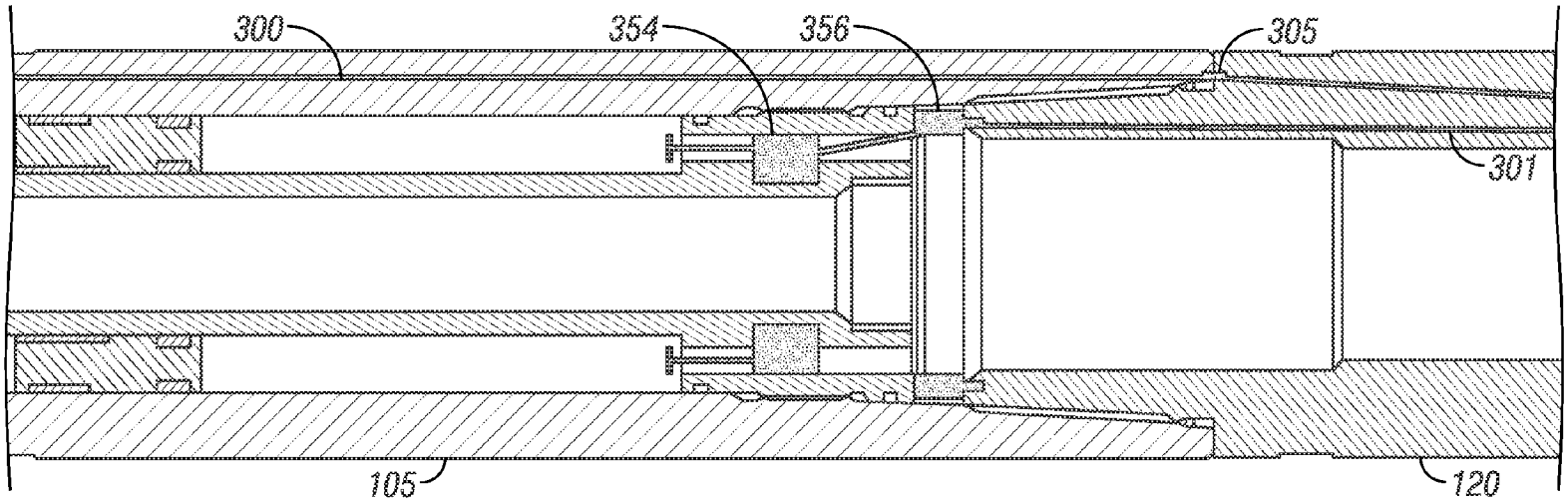
FIG. 22 is an enlarged view of the lower portion of the circulation sub shown in FIG. 21.

FIG. 21 shows another aspect of the invention. In this aspect, the MOCS 105 tool is configured to provide an operator the ability to lock the tool in one position or another electrically. One or more piston mechanisms 354 is disposed in the sub 105 and remotely activated by one or more actuators 356 (e.g., solenoid, servo, motor) to lock the valve from moving in relation to the valve body or to lock the valve in the bypass or non-bypass position when flowing. Activation of the piston mechanism(s) 354 allows an operator to lock and unlock the valve by trapping fluid between the valve mandrel and the floater piston, preventing the valve from shifting down since the fluid in front of the floater needs to be displaced for the valve to move. FIG. 22 is an enlarged view of this aspect. To unlock the tool the piston mechanism 354 is activated to open a flow path so the floater piston 155 can move. This provides a hydraulic lock to maintain the valve in place.

Figure 23:
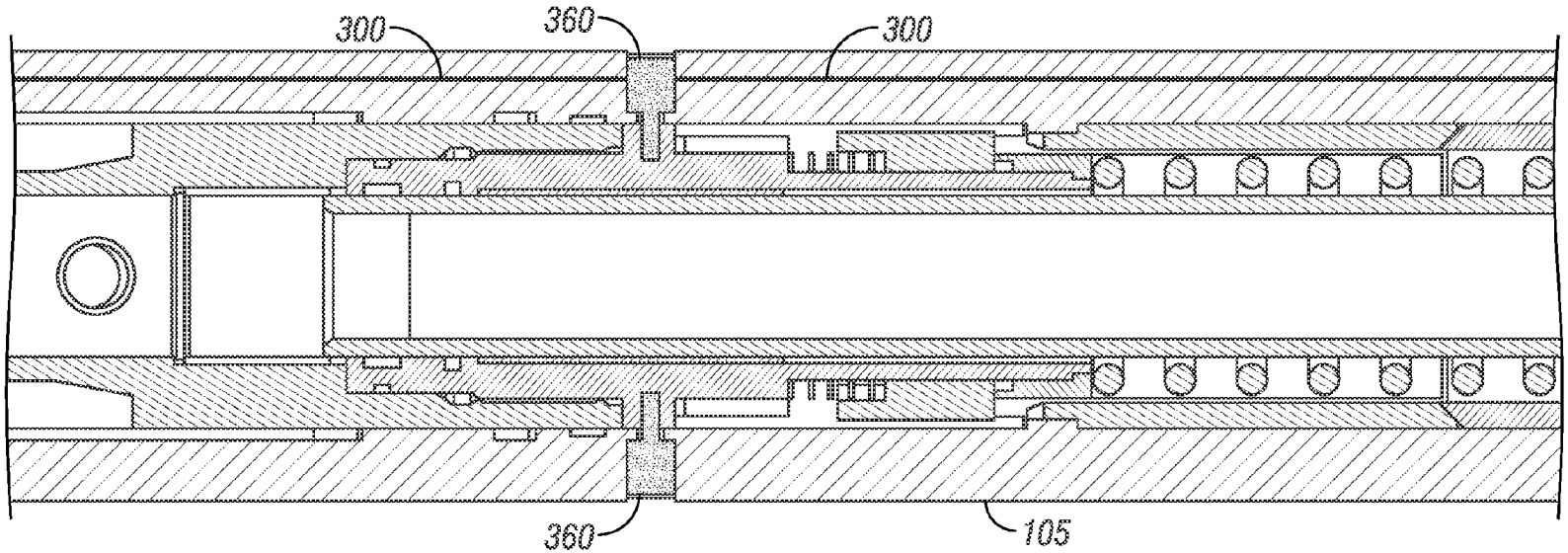
FIG. 23 is an enlarged view of an exemplary wired circulation sub in accordance with aspects of the invention.

FIG. 23 shows another aspect of the invention. In this aspect, the MOCS 105 includes a pair of electrically operated shear pins 360 (e.g., solenoid, servo, motor). These pins 360 are actuated via a signal along the conductor 300 to lock the tool from moving until the tool is unlocked. Unlocking the tool is done by activating the pins 360 to retract, thus allowing the valve piston to move axially. It will be appreciated by those skilled in the art that conventional shear pin apparatus or the equivalent may be used to implement such aspects of the invention.

Figure 24:
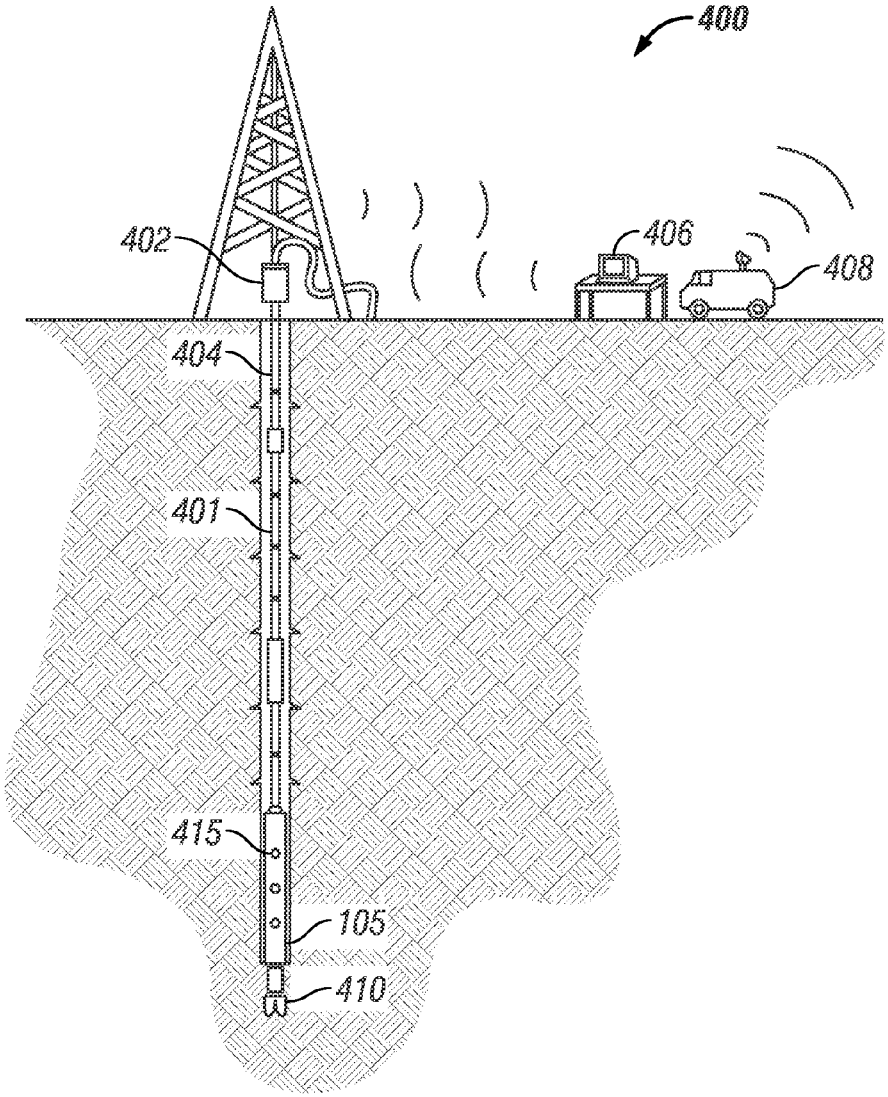
FIG. 24 is a schematic representation of a downhole transmission network in use on a drilling rig in accordance with aspects of the invention.

Turning to FIG. 24, a telemetry network 400 aspect of the invention is shown. A drill string 401 is formed by a series of wired drill pipes connected for communication across the junctions using communication elements 305 as disclosed herein. It will be appreciated by those skilled in the art that the wired MOCS 105 aspects of the invention can be disposed subsurface along other forms of conveyance, such as via coiled tubing. A top-hole repeater unit 402 is used to interface the network 400 with drilling control operations and with the rest of the world. In one aspect, the repeater unit 402 rotates with the kelly 404 or top-hole drive and transmits its information to the drill rig by any known means of coupling rotary information to a fixed receiver. In another aspect, two communication elements 305 can be used in a transition sub, with one in a fixed position and the other rotating relative to it (not shown). A computer 406 in the rig control center can act as a server, controlling access to network 400 transmissions, sending control and command signals downhole, and receiving and processing information sent up-hole. The software running the server can control access to the network 400 and can communicate this information, in encoded format as desired, via dedicated land lines, satellite link (through an uplink such as that shown at 408), Internet, or other known means to a central server accessible from anywhere in the world. A MOCS 105 tool is shown linked into the network 400 just above the drill bit 410 for communication along its conductor 300 path and along the wired drill string 401.

The MOCS 105 aspect shown in FIG. 24 includes a plurality of transducers 415 disposed on the tool 105 to relay downhole information to the operator at surface or to a remote site. The transducers 415 may include any conventional source/sensor (e.g., pressure, temperature, gravity, etc.) to provide the operator with formation and/or borehole parameters, as well as diagnostics or position indication relating to the tool/valve. In an aspect where the MOCS 105 is equipped with a pressure transducer 415, a low reading below the valve would indicate to an operator that the valve is open to the annulus. If the pressure transducer 415 indicates pressure similar to the stand pipe pressure, then the valve is closed to the annulus. Valve position can also be relayed through the network 400 using other proximity detectors or LVDT sensors disposed on the tool to indicate bypass and non-bypass. Another aspect of the invention may be configured to provide for remote valve activation via conductor 300 to electronically index the index teeth 180 in the indexer 165 to select either the bypass or non bypass position slot as described herein. This configuration allows the tool to be activated, without shifting positions every time the pumps are cycled off and on. It will be appreciated by those skilled in the art that any conventional type of transducer may be disposed on the MOCS 105 for communication along the network 400 as known in the art.

Advantages provided by the MOCS aspects of the invention include: real-time selection and operation of the valve configurations; real-time venting of drilling fluid and fluid with Lost Circulation Material to the annulus through the outer body of the tool while blocking flow through the tool when desired; real-time selection of porting to the annulus or the bit; and real-time indication of valve position and elimination of the need for drop balls to activate and deactivate the tools. However, some aspects of the invention may be implemented to include use of a drop ball(s) in conjunction with the wired MOCS.

While the present disclosure describes specific aspects of the invention, numerous modifications and variations will become apparent to those skilled in the art after studying this disclosure, including use of equivalent functional and/or structural substitutes for elements described herein. For example, aspects of the invention can also be implemented for operation in telemetry networks 400 combining multiple signal conveyance formats (e.g., mud pulse, fiber-optics, acoustic, EM hops, etc.). It will also be appreciated by those skilled in the art that the tool activation techniques disclosed herein can be implemented for selective operator activation and/or automated/autonomous operation via software/firmware configured into the MOCS and/or the network 400 (e.g., at surface, downhole, in combination, and/or remotely via wireless links tied to the network). All such similar variations apparent to those skilled in the art are deemed to be within the scope of the invention as defined by the appended claims.

What is claimed is:

1. A downhole tool for circulating fluid within a well bore comprising:

a tubular housing configured with a conductor for passage of a signal between communication elements disposed at the ends thereof;

wherein the communication elements are configured to link the housing to a downhole communication network;

the housing having an outer port;

a piston slidably disposed in the housing and having one or more piston ports;

an inner flow bore extending through the housing and the piston including a primary fluid flow path; and an obturating member defining a through tool bypass from the primary fluid flow path around the obturating member and back to the primary fluid flow path;

wherein the piston includes a first position isolating the outer port from the primary fluid flow path and a second position exposing the outer port to the primary fluid flow path to provide a bypass flow path between the inner flow bore and a well bore annulus;

wherein the piston is moveable between the first and second positions in response to a pressure differential across the obturating member while the signal is passable along the conductor in the tubular housing.

2. The downhole tool of claim 1, further comprising a locking mechanism configured to lock the piston into either the first position or the second position in response to receiving a signal from the downhole communication network.

3. The downhole tool of claim 2, wherein the locking mechanism comprises a piston mechanism disposed on the housing.

4. The downhole tool of claim 2, wherein the locking mechanism comprises at least one pin disposed on the housing to prevent movement of the piston in the housing.

5. The downhole tool of claim 1, wherein the housing is configured to alter fluid flow along the inner flow bore based on a signal passed along the downhole communication network.

6. The downhole tool of claim 1, wherein the communication elements comprise inductive couplers.

7. The downhole tool of claim 1, further comprising at least one transducer disposed on the housing to make a downhole measurement and convey measurement parameter data along the communication network.

8. The downhole tool of claim 1, further comprising at least one transducer disposed on the housing to detect a pressure parameter downhole and convey parameter data along the communication network.

9. The downhole tool of claim 1, wherein the tool is configured so as to divert all or part of the fluid flow to the well bore annulus when the outer port of the housing is exposed.

10. The downhole tool of claim 1, further comprising an indexing mechanism coupled between the housing and the piston to guide the piston between the first and second positions.

11. The downhole tool of claim 10, wherein the indexing mechanism further includes a fixed spline sleeve and a rotatable index ring.

12. The downhole tool of claim 11, wherein the spline sleeve is fixed to the housing.

13. The downhole tool of claim 12, wherein the fixed spline sleeve includes angled tabs and inner splines slidable into alternating long slots and short slots on the rotatable index ring.

14. A system for circulating fluid within a well bore comprising:

a tubular string having an inner flow bore;

a housing coupled into the tubular string;

the housing providing an inner fluid flow bore and configured with a port, the inner flow bore including a primary fluid flow path;

the housing configured with a conductor for passage of a signal between communication elements disposed at the ends thereof;

wherein the communication elements are configured to link the housing to a downhole communication network; and a piston disposed in the housing, the piston selectively moveable to isolate the port from the inner fluid flow bore in a first position and expose the port to the inner fluid flow bore in a second position;

a valve mechanism disposed in the housing and configured to actuate the piston between the first position and the second position in response to receiving a signal from the downhole communication network;

wherein an entire fluid flow is directed from the inner fluid flow bore to the exposed port when the piston is in the second position.

15. The system of claim 14, wherein the tubular string is configured so as to divert all or part of the fluid flow to the well bore annulus when the housing port is exposed.

16. The system of claim 14, wherein the housing is configured for movement of the piston in the housing based on the signal passed along the downhole communication network.

17. The system of claim 14, wherein the valve mechanism is disposed at the upstream end of the piston.

18. The system of claim 14, wherein the valve mechanism is disposed at the downstream end of the piston.

19. The system of claim 14, wherein the communication elements comprise inductive couplers.

20. The system of claim 14, further comprising at least one transducer disposed on the housing to make a downhole measurement and convey measurement parameter data along the communication network.

21. The system of claim 14, further comprising at least one transducer disposed on the housing to detect a pressure parameter downhole and convey parameter data along the communication network.

22. A method for circulating fluid within a well bore comprising:

disposing a circulation sub having an inner flow bore and an outer port in the well bore, the sub configured with a conductor for passage of a signal between communication elements disposed at the ends thereof;

flowing a fluid along a primary fluid flow path extending through a piston disposed within the circulation sub;

wherein the communication elements are configured to link the sub to a downhole communication network; and transmitting the signal along the communication network and through the sub along the conductor; and deploying an obturating member into the primary fluid flow path to move the piston from a first position isolating the outer port from the primary fluid flow path to a second position exposing the outer port to the primary fluid flow path to provide a bypass flow path between the inner flow bore and a well bore annulus.

23. The method of claim 22, further comprising locking the piston into either the first position or the second position by transmitting a signal from the downhole communication network to a locking mechanism in the circulation sub.

24. The method of claim 23, wherein locking the piston into either the first or second position comprises actuating a piston mechanism.

25. The method of claim 23, wherein locking the piston into either the first or second position comprises actuating at least one shear pins.

26. The method of claim 22, wherein the communication elements comprise inductive couplers.

27. The method of claim 22, further comprising isolating or exposing the outer port on the sub to the fluid flow path based on signal data attained with at least one transducer disposed on the sub.

28. The method of claim 22, further comprising isolating or exposing the outer port on the sub to the inner fluid flow path based on downhole pressure parameter data transmitted along the communication network.

29. The method of claim 22, wherein exposing the outer port of the sub to the primary fluid flow path comprises exposing the port to all or part of the fluid flow.

* * * * *